US007798478B2

(12) United States Patent
Janson et al.

(10) Patent No.: US 7,798,478 B2
(45) Date of Patent: Sep. 21, 2010

(54) PARALLEL CLAMP AND ACCESSORIES THEREFOR

(75) Inventors: John C. Janson, East Dundee, IL (US); Guojue Yan, Carpentersville, IL (US); Steven A. Erbach, Marengo, IL (US); Timothy J. Shipley, Bensenville, IL (US)

(73) Assignee: Walter Meier (Manufacturing) Inc., LaVergne, TN (US)

( * ) Notice: Subject to any disclaimer, the term of this patent is extended or adjusted under 35 U.S.C. 154(b) by 177 days.

(21) Appl. No.: 11/063,674

(22) Filed: Feb. 23, 2005

(65) Prior Publication Data

US 2005/0184439 A1 Aug. 25, 2005

Related U.S. Application Data

(60) Provisional application No. 60/546,853, filed on Feb. 23, 2004.

(51) Int. Cl.
*B25B 1/02* (2006.01)

(52) U.S. Cl. ..... 269/6; 269/3; 269/166

(58) Field of Classification Search ..... 269/6, 269/166–172, 900, 99, 100, 101, 102, 96, 269/147–149, 249, 143, 3
See application file for complete search history.

(56) References Cited

U.S. PATENT DOCUMENTS 449,987 A 4/1891 Wies
457,710 A 8/1891 Emmert
488,600 A 12/1892 Cowell
614,457 A * 11/1898 Light ..... 112/35
693,811 A 2/1902 Yonge (Continued)

FOREIGN PATENT DOCUMENTS

BE 442 004 A 8/1941

(Continued)

OTHER PUBLICATIONS

Rhombus Tools Limited, United Kingdom Publication, "A Sliding Jaw Clamp," Nov. 9, 1988, 2 pages.

(Continued)

*Primary Examiner*—Lee D Wilson
(74) *Attorney, Agent, or Firm*—Fitch, Even, Tabin & Flannery

(57) ABSTRACT

An apparatus for securing a workpiece is provided. In one form, the apparatus is configured such that the clamping jaws of the apparatus lie flush against the workpiece and the pressure from the pressure application mechanism is distributed substantially equally over the surface of the workpiece in contact with the jaws of the apparatus. Additionally, the apparatus is provided with a brake mechanism which allows at least one of the clamping jaw members to be secured in a desired position on the elongated member without having to tilt the jaw member connected thereto. In another form, the apparatus may have two brake release mechanisms to account for the various positions the apparatus may be placed in with respect to a workpiece. The apparatus may also have mating structures which allow the apparatus to be connected to a work surface. In addition, the apparatus may also include a pivoting pressure application member handle to assist the user in applying or removing pressure to the workpiece.

43 Claims, 25 Drawing Sheets

U.S. PATENT DOCUMENTS

| | | | | |
|---|---|---|---|---|
| 703,376 | A | | 7/1902 | Bingham |
| 753,837 | A | | 3/1904 | Barcus |
| 777,611 | A | | 12/1904 | Dodge |
| 979,305 | A | | 12/1910 | Hunt |
| 1,012,226 | A | | 12/1911 | Starrett |
| 1,106,096 | A | | 8/1914 | Hunt |
| 1,335,721 | A | | 4/1920 | Bergstrom |
| 1,410,184 | A | | 3/1922 | Hunter |
| 1,497,107 | A | | 6/1924 | Lasell |
| 1,739,488 | A | | 12/1929 | Thayer |
| 1,811,518 | A | | 6/1931 | Palmer |
| 1,890,114 | A | | 12/1932 | Fulton |
| 2,149,541 | A | | 3/1939 | Nagle |
| D145,641 | S | | 9/1946 | Thomson |
| 2,430,458 | A | | 11/1947 | Farrell |
| 2,432,352 | A | * | 12/1947 | Strotz ..... 269/101 |
| 2,559,925 | A | | 7/1951 | Barker |
| 2,592,076 | A | | 4/1952 | Spinnler |
| 2,669,958 | A | | 2/1954 | Sweeney |
| 2,704,951 | A | | 3/1955 | Petersen |
| 2,734,409 | A | | 2/1956 | Schum et al. |
| 2,735,462 | A | | 2/1956 | Olsen |
| 2,788,688 | A | | 4/1957 | Atkins |
| D181,115 | S | | 10/1957 | Vogl |
| 3,007,358 | A | | 11/1961 | Vogl et al. |
| 3,096,975 | A | | 7/1963 | Irwin |
| 3,193,277 | A | | 7/1965 | Nagamori |
| 3,224,752 | A | | 12/1965 | Benbow |
| 3,281,140 | A | | 10/1966 | Smierciak |
| 3,307,843 | A | | 3/1967 | Torossian |
| 3,377,061 | A | | 4/1968 | Watson |
| 3,492,886 | A | * | 2/1970 | Naureckas ..... 74/424.78 |
| 3,663,005 | A | | 5/1972 | Peddinghaus |
| 3,669,440 | A | | 6/1972 | Kartasuk et al. |
| 3,675,916 | A | | 7/1972 | Kartasuk et al. |
| 3,768,797 | A | | 10/1973 | Kartasuk et al. |
| 3,883,128 | A | | 5/1975 | Breese |
| 4,040,613 | A | | 8/1977 | Kartasuk et al. |
| 4,042,264 | A | | 8/1977 | Shumer |
| 4,057,239 | A | | 11/1977 | Hopf et al. |
| 4,081,112 | A | | 3/1978 | Chang |
| 4,185,811 | A | | 1/1980 | Long |
| 4,220,322 | A | | 9/1980 | Hobday |
| 4,253,648 | A | | 3/1981 | Meeks |
| 4,339,113 | A | | 7/1982 | Vosper |
| 4,436,294 | A | | 3/1984 | Irelan |
| 4,534,547 | A | | 8/1985 | Cox |
| 4,563,921 | A | | 1/1986 | Wallace |
| 4,830,350 | A | | 5/1989 | Kuei |
| 4,893,801 | A | | 1/1990 | Flinn |
| 4,921,234 | A | | 5/1990 | Peterson |
| 4,926,722 | A | | 5/1990 | Sorensen et al. |
| 4,932,638 | A | | 6/1990 | Chen |
| 4,971,301 | A | | 11/1990 | Yang |
| 4,989,847 | A | | 2/1991 | Chapman |
| 5,005,449 | A | | 4/1991 | Sorensen et al. |
| 5,009,134 | A | | 4/1991 | Sorensen et al. |
| 5,022,137 | A | | 6/1991 | Sorensen et al. |
| D320,919 | S | | 10/1991 | Sorensen |
| 5,094,131 | A | | 3/1992 | Sorensen et al. |
| D328,846 | S | | 8/1992 | Sorensen et al. |
| 5,161,787 | A | | 11/1992 | Hobday |
| D333,602 | S | | 3/1993 | Gatzemeyer et al. |
| 5,191,821 | A | | 3/1993 | Metzger, Jr. et al. |
| 5,197,360 | A | * | 3/1993 | Wooster, Jr. ..... 269/170 |
| 5,222,420 | A | * | 6/1993 | Sorensen et al. ..... 269/6 |
| 5,312,094 | A | | 5/1994 | Zera |
| 5,348,276 | A | | 9/1994 | Blacker |
| 5,400,844 | A | | 3/1995 | Pollack |
| 5,421,384 | A | | 6/1995 | Nuwordu |
| 5,427,364 | A | | 6/1995 | Zborschil |
| 5,454,551 | A | | 10/1995 | Hobday |
| D366,820 | S | | 2/1996 | Wooster, Jr. et al. |
| 5,553,838 | A | * | 9/1996 | Lee ..... 269/100 |
| 5,568,916 | A | | 10/1996 | Gibbons et al. |
| 5,586,754 | A | | 12/1996 | Williams |
| 5,593,147 | A | | 1/1997 | Read |
| 5,692,734 | A | | 12/1997 | Aldredge, Sr. |
| 5,775,680 | A | | 7/1998 | Sorensen et al. |
| 5,826,310 | A | | 10/1998 | Hobday |
| 5,830,091 | A | | 11/1998 | Romanick |
| 5,853,168 | A | | 12/1998 | Drake |
| D417,377 | S | | 12/1999 | Blank et al. |
| 6,039,313 | A | | 3/2000 | Baculy |
| 6,079,703 | A | | 6/2000 | Chavez, Jr. |
| 6,113,085 | A | | 9/2000 | Lindenthal et al. |
| 6,135,435 | A | | 10/2000 | Schmitz |
| 6,161,823 | A | | 12/2000 | Bradford |
| 6,220,589 | B1 | | 4/2001 | Smith, III et al. |
| 6,347,792 | B1 | | 2/2002 | O'Brien |
| 6,412,158 | B1 | | 7/2002 | Moore |
| 6,412,767 | B1 | | 7/2002 | Beckmann et al. |
| 6,450,489 | B1 | | 9/2002 | Wang |
| D471,070 | S | | 3/2003 | Howell |
| 6,530,565 | B1 | | 3/2003 | Simpson |
| 6,595,508 | B2 | | 7/2003 | Duncan |
| 6,676,120 | B1 | | 1/2004 | Hallbeck et al. |
| D487,220 | S | | 3/2004 | Phillips |
| D487,864 | S | | 3/2004 | Varzino |
| D488,044 | S | | 4/2004 | Varzino |
| D494,828 | S | | 8/2004 | Phillips |
| D500,238 | S | | 12/2004 | Varzino |
| 6,848,683 | B2 | | 2/2005 | Foshag et al. |
| 2002/0043752 | A1 | | 4/2002 | Reed et al. |
| 2003/0090048 | A1 | | 5/2003 | Varzino et al. |
| 2003/0102614 | A1 | | 6/2003 | Foshag et al. |
| 2003/0116901 | A1 | | 6/2003 | Roesch |
| 2004/0041061 | A1 | * | 3/2004 | Krohmer ..... 248/74.1 |
| 2004/0070132 | A1 | | 4/2004 | Varzino et al. |
| 2004/0140602 | A1 | | 7/2004 | Gerritsen et al. |
| 2005/0184439 | A1 | * | 8/2005 | Janson et al. ..... 269/6 |

FOREIGN PATENT DOCUMENTS

| | | | |
|---|---|---|---|
| CH | 252 404 | | 9/1948 |
| DE | 175 307 | | 9/1906 |
| DE | 328 149 | | 10/1920 |
| DE | 332 373 | | 2/1921 |
| DE | 942 320 | | 5/1956 |
| DE | 1 099 478 | | 2/1961 |
| DE | 2 149 012 | | 4/1972 |
| DE | 2 326 546 | | 12/1974 |
| DE | 24 03 830 | B1 | 3/1975 |
| DE | GM 75 13 254 | U | 8/1975 |
| DE | 2737904 | | 3/1979 |
| DE | 28 06 555 | A1 | 8/1979 |
| DE | 28 44 838 | A1 | 4/1980 |
| DE | 30 49 462 | A1 | 7/1982 |
| DE | G 87 03 379 | U1 | 9/1987 |
| DE | G 89 07 067 | U1 | 9/1989 |
| DE | 42 36 049 | A1 | 4/1994 |
| DE | 195 46 048 | A1 | 6/1997 |
| DE | 103 12 306 | A1 | 9/2004 |
| DE | 103 12 316 | A1 | 9/2004 |
| EP | 0 010 260 | A3 | 4/1980 |
| EP | 0 010 260 | B1 | 4/1983 |
| EP | 1 574 291 | A2 | 9/2005 |
| FR | 2 756 766 | A1 | 6/1998 |
| GB | 344317 | | 3/1931 |
| GB | 443381 | | 2/1936 |
| GB | 637632 | | 5/1950 |
| GB | 819506 | | 9/1959 |
| GB | 888584 | | 1/1962 |
| GB | 956390 | | 4/1964 |

| | | | |
|---|---|---|---|
| GB | 973387 | | 10/1964 |
| GB | 1 371 603 | | 10/1974 |
| GB | 1 376 105 | | 12/1974 |
| GB | 1 408 886 | | 10/1975 |
| GB | 1 555 455 | | 11/1979 |
| GB | 2 063 111 | A | 6/1981 |
| GB | 2 103 122 | A | 2/1983 |
| GB | 2 178 689 | A | 2/1987 |
| GB | 2 182 271 | A | 5/1987 |
| GB | 2 204 260 | A | 11/1988 |
| GB | 2 204 263 | A | 11/1988 |
| GB | 2 204 264 | A | 11/1988 |
| GB | 2 204 822 | A | 11/1988 |
| GB | 2 214 109 | A | 8/1989 |
| GB | 2 221 634 | A | 2/1990 |
| GB | 2 369 593 | A | 6/2002 |
| WO | WO-88/07434 | A1 | 10/1988 |
| WO | WO-02/30622 | A2 | 4/2002 |
| WO | WO-02/030622 | A3 | 7/2002 |

OTHER PUBLICATIONS

McCafferty, Phil, "One-Hand Clamp," *Popular Science*, Aug. 1989, 3 pages.

Wilton Corporation 2001 Catalog, 21 pages.

WMH Tool Group, Inc. drawings illustrating an apparatus that was on sale or publicly available before Jan. 21, 2002.

PCT International Search Report for PCT/US02/36334 dated Mar. 31, 2003, 7 pages.

European Search Report for EP 04 00 1069.6 dated Oct. 27, 2004, 6 pages.

Adjustable Clamp Company Product Guide (including the Jorgensen Cabinet Master 90° Parallel Clamp) published at http://www.adjustableclamp.com on May 26, 2002 and archived at http://web.archive.org (14 pages).

PCT International Search Reeport and Written Opinion of the International Searching Authority for corresponding International Application No. PCT/US05/05752 dated Jun. 29, 2006 (10 pages).

Office Action for Chinese Application 200580005702.8, Dec. 7, 2007, State Intellectual Property Office of P.R.C., China.

European Patent Office, Supplemental European Search Report for Application No. 05723573.1 dated Dec. 16, 2009, 5 pages.

* cited by examiner

PARALLEL CLAMP AND ACCESSORIES THEREFOR

CROSS-REFERENCE TO RELATED APPLICATION

This application claims benefit of U.S. Provisional Application No. 60/546,853, filed Feb. 23, 2004, which is hereby incorporated herein by reference in its entirety.

FIELD OF THE INVENTION

The present invention is directed to an apparatus for securing a workpiece and, more particularly, to a parallel clamp wherein the clamp jaws are positioned generally flush with the workpiece when the workpiece is secured by the clamp.

BACKGROUND OF THE INVENTION

The tool industry currently offers a variety of tools for securing workpieces in industrial, workplace or workshop settings, including vises, bar clamps, C-clamps, and various other types of clamps. Each of these tools have their own specific advantages and disadvantages. For example, a vise provides a strong and sturdy apparatus for securing a workpiece, but is not typically portable and therefore cannot be easily used in multiple locations.

Bar clamps serve as alternatives to a vise in situations where an apparatus for securing a workpiece is required, but the workpiece is at a remote location and/or cannot be placed on a benchtop. Some bar clamps also have the added advantage of being able to be used as both a clamp and a spreader.

Some drawbacks of prior art bar clamps are that the jaws of the clamp members are often not parallel to one another or flush with the workpiece being secured by the clamp. The inability of the clamp jaws to remain parallel to one another and generally perpendicular to the bar is often caused by one of two factors. First, the way in which the movable clamp member is locked into position on the bar of the bar clamp will often cause the clamp member and associated jaw to angle slightly away from or towards the workpiece when the locking mechanism is engaged. For example, in the passive locking bar clamp illustrated in FIG. 14, the movable clamp member 1 is locked into position by simply angling the clamp member 1 with respect to the bar 2, which creates a frictional engagement between the clamp member 1 and the bar 2. The frictional engagement prevents the clamp member 1 from slipping or moving when securing a workpiece. In some instances, the upper and/or lower surfaces of the bar may also be serrated so that the edge of the clamp member opening through which the bar 2 passes catches a tooth of the serrated bar to prevent the clamp member 1 from moving or slipping away from the workpiece. Although this configuration allows for the movable clamp member 1 to be rapidly moved along the bar 2, it angles the jaw 1*a* associated with the movable clamp 1 and prevents the jaw 1*a* from remaining parallel to the jaw 3*a* of fixed clamp member 3 and generally perpendicular to the bar 2.

Similarly, in the locking bar clamp illustrated in FIG. 15, the movable clamp member 1' is locked into position via a brake plate 1*b'* which is biased at an angle to the bar 2' by a spring to prevent the movable clamp member 1' and brake plate from being moved about the bar 2'. The movable clamp member 1' is secured into position on the bar 2' due to the friction created between the angled brake plate 1*b'* and the bar 2'. The bar 2' may also be serrated so that the edge of the brake plate opening through which the bar passes catches a tooth of the serrated bar 2' to prevent the clamp member 1' from moving or slipping away from the workpiece. The biasing of the brake plate into engagement with the bar 2' often causes the clamp member 1' and jaw 1*a'* to angle with respect to the bar 2' and with respect to the other clamp member 3' and jaw 3*a'*.

Thus, while the clamp jaws of prior art bar clamps may initially be parallel to one another and flush with the workpiece when positioning the movable clamp member about the bar, the jaw of the movable clamp member typically angles with respect to the other clamp jaw when the locking mechanism of the clamp member is engaged, thereby causing the top of the clamp jaw to no longer be flush against the workpiece.

A second factor preventing the jaws of prior art bar clamps from lying flush against the workpiece or parallel to one another is the fact that the pressure application mechanism, which is necessary to tightly hold the workpiece with the jaws of the bar clamp, is generally located at, or near, the end of at least one of the clamp members. Thus, when pressure is applied to a workpiece using prior art bar clamps, the pressure is concentrated at the top of the clamp which may cause the clamp member and associated jaw to angle slightly with respect to the workpiece, the bar and/or the other clamp member. The angling of the clamp member can prevent the associated jaw from lying flush with the surface of the workpiece and parallel to the other clamp member, which in turn, can make it difficult to clamp the workpiece as desired.

Another shortcoming with respect to prior art bar clamps is that most of the jaws associated with the pressure application mechanism have relatively small surface areas and, thus, do not distribute the pressure over a large surface of the workpiece. The inability to distribute the pressure across the surface of the workpiece often leads to problems such as bowing, warping, and turning of the workpiece, and makes it difficult to accomplish tasks with strict tolerances, such as clamping a workpiece together at a particular angle.

Attempts have been made to overcome some of these shortcomings. For example, European Patent No. EP0010260 B1 discloses a parallel clamp (or body clamp) which has a movable clamp member made up of two pieces, with one piece (14) being secured squarely to the bar (10) and forming a jaw and a second piece (24) being movable about the bar and capable of angling with respect thereto in order to lock the movable clamp member in position. The pressure application mechanism connects the pieces of the movable clamp such that the second piece (24) can be angled with respect to the bar (10) without angling the first piece (14) containing the jaw member. In this manner, the jaws of fixed clamp member (12) and the first piece (14) of the movable clamp member are able to remain parallel to one another and perpendicular to the bar (10).

One shortcoming with the parallel clamp disclosed in EP0010260 B1, however, is that the second piece (24) of the movable clamp member must be tilted or wiggled in order to move the movable bar clamp member along the bar. Moreover, the tilting must be maintained for as long as the movable bar clamp member is moved, otherwise, the second piece (24) will frictionally engage the bar (10) and prevent further movement. This configuration makes it awkward to move the movable bar clamp member along the bar and difficult to move the movable bar clamp member over long distances.

Another shortcoming with prior art parallel clamps is that they do not account for the various positions the clamp may be in when the operator attempts to release the workpiece. For example, in some applications the parallel clamp may be positioned upside down when securing the workpiece or in a position where the pressure application mechanism is not readily accessible. Thereby making it difficult for the operator to release the workpiece.

Yet another shortcoming with existing bar clamps is their inability to interface with other pieces of equipment that are designed to work with specific workpieces. For example, many types of workbenches are designed specifically for woodworking and working with wood workpieces. Existing bar clamps, however, are not designed to interface with these workbenches and fail to take advantage of the unique properties they possess.

Lastly, existing parallel clamps do not adequately account for applications in which a large force must be applied to the workpiece. For example, most (if not all) parallel clamps provide a pressure application member having a fixed handle which requires the operator to twist or rotate the handle in order to apply pressure to the workpiece. Although this type of handle configuration is easy to use when only a small amount of force is being applied to the workpiece, it becomes difficult to twist or rotate when attempting to apply a large amount of force to the workpiece.

Accordingly, it has been determined that the need exists for an improved bar clamp which overcomes the aforementioned limitations and which further provides capabilities, features and functions, not available in current bar clamps.

DETAILED DESCRIPTION OF THE PREFERRED EMBODIMENT(S)

Figure 1A:
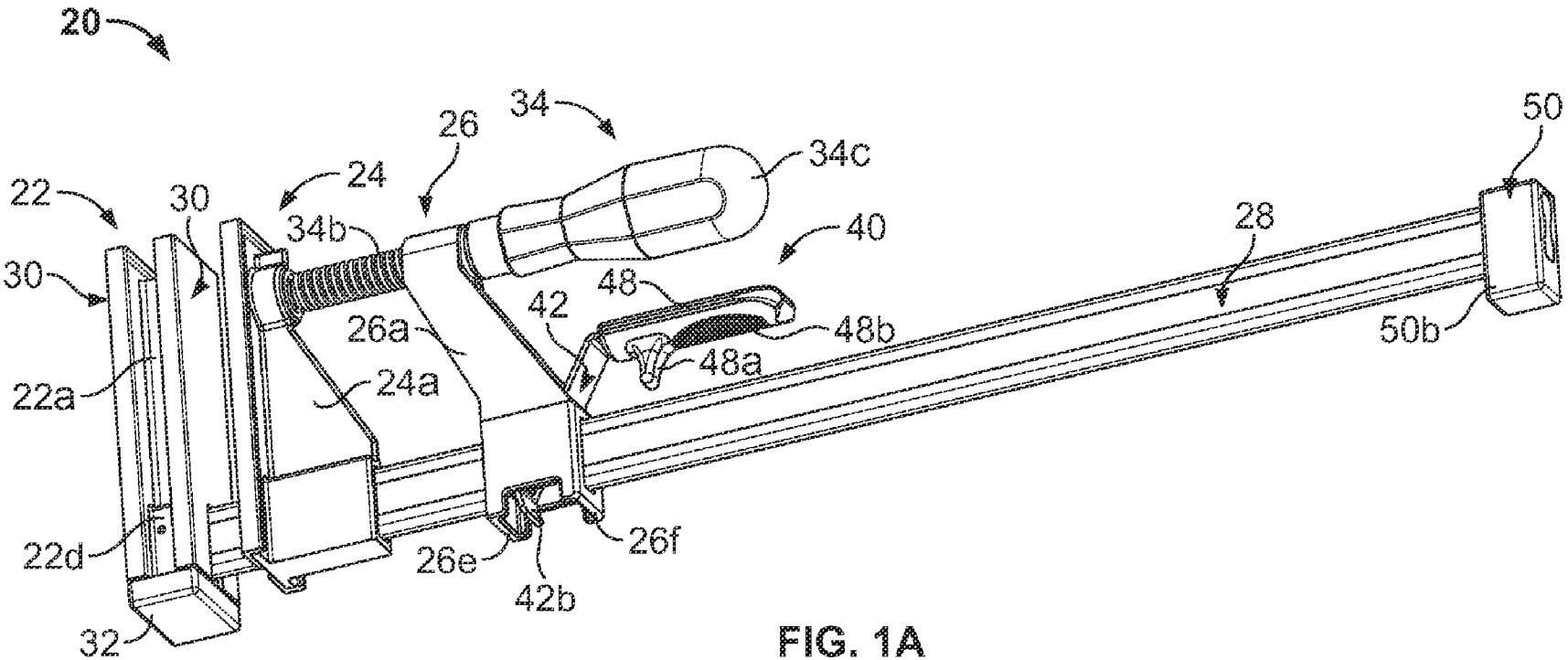
FIG. 1A is a perspective view of a parallel clamp embodying features of the present invention.
Figure 1B:
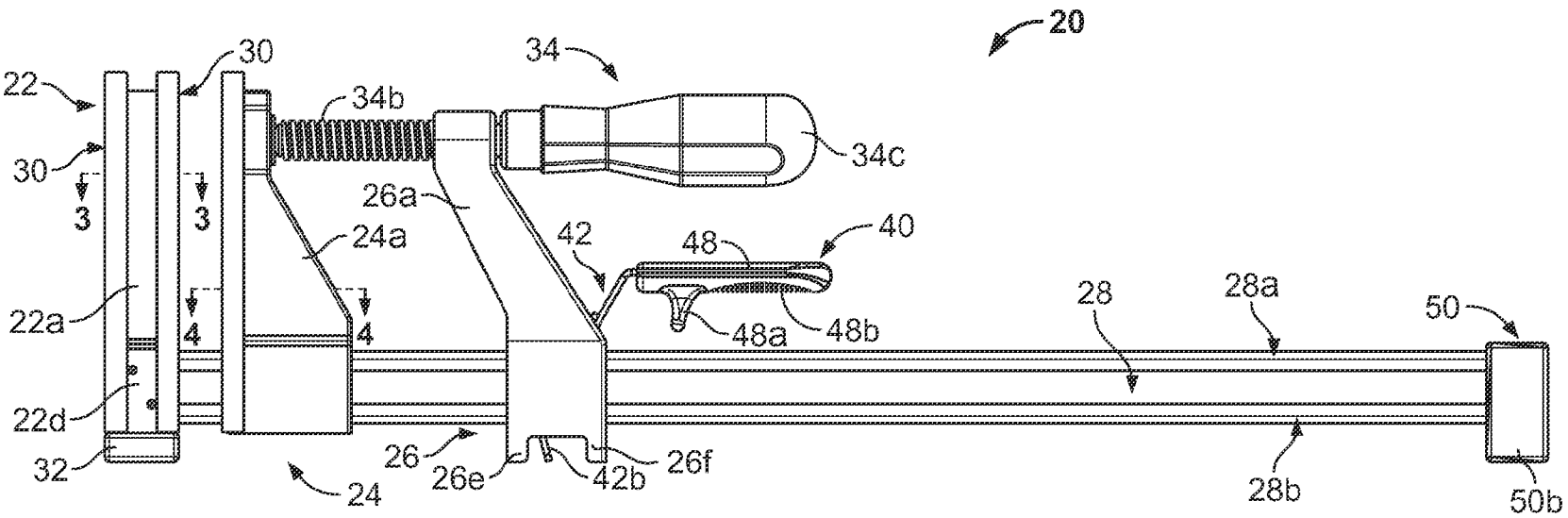
FIG. 1B is a side elevational view of the parallel clamp of FIG. 1A, the opposite side elevational view being the mirror image thereof.

Referring to FIGS. 1-6, an apparatus for securing a workpiece is shown and generally identified by the reference numeral 20. The apparatus 20 is symmetrical about its longitudinal axis and includes a first clamping jaw member 22, a second clamping jaw member 24, a locking arm 26 and a transportable elongated member, such as bar 28, to which the clamping jaw members 22 and 24 and locking arm 26 are adjustably mounted for being shifted between clamped and unclamped positions to secure a workpiece. In the embodiment illustrated, the first clamping jaw member 22 is preferably fixed to the bar 28 and remains stationary on the elongated member 28 during a workpiece clamping operation while the second clamping jaw member 24 and locking arm 26 are moveable with respect to the bar 28 and, preferably, slidable thereon. It should be understood, however, that in alternate embodiments a moveable first clamping jaw member may be provided, if desired, so that the first clamping jaw member may be moved to, and secured at, a plurality of different positions along the bar 28.

Figure 1C:
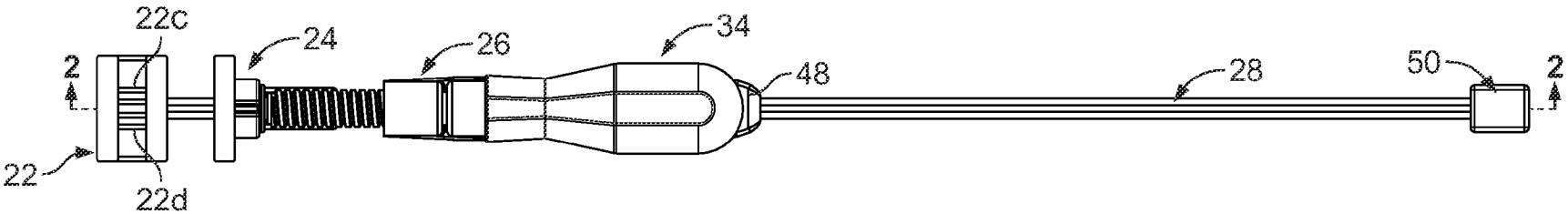
FIG. 1C is a plan view of the parallel clamp of FIG. 1A illustrating that the parallel clamp is symmetrical about its longitudinal axis.
Figure 1D:
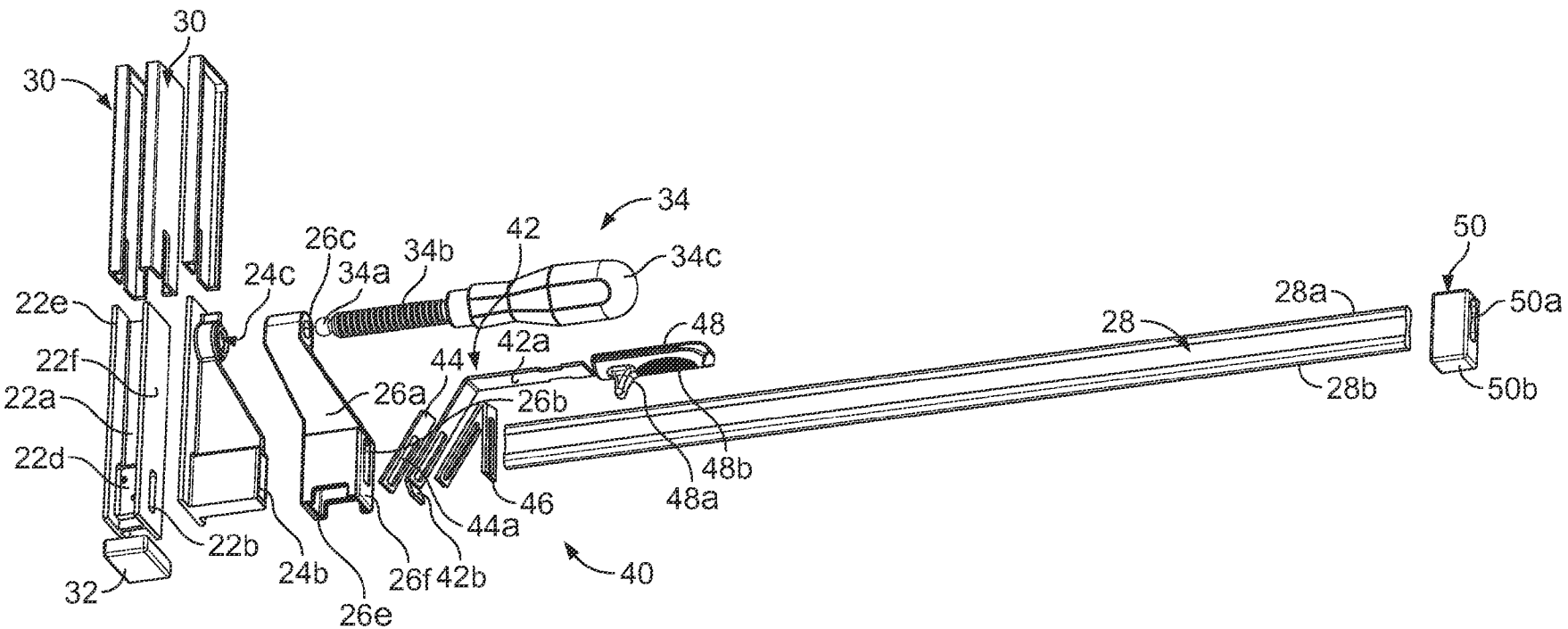
FIG. 1D is an exploded perspective view of the parallel clamp of FIG. 1A illustrating the internal components of the braking mechanism.

As illustrated in FIGS. 1C-D, the elongated member 28 is preferably a generally rectangular shaped bar having a width that is approximately one-fourth (¼th) its height and has indentations on each side of the bar, such that the bar 28 has a roughly I-shaped or figure-eight shaped cross-section. The length of the elongated member 28 may vary in accordance with the dimensions of the workpiece that the apparatus 20 is intended to secure. For example, the bar 28 may be provided in lengths of six, twelve, eighteen, twenty-four, thirty-two, thirty-six, forty, forty-eight, sixty, eighty and one hundred inches, or in other lengths that may be needed to accommodate specific workpieces.

The top 28*a* and bottom 28*b* of the elongated member 28 may be evenly cornered or rounded along their edges, while the upper and lower most surfaces and side surfaces of the elongated member 28 are preferably flat and parallel to one another so that the surfaces may provide additional support to the workpiece being secured by the clamping jaw members 22 and 24. That is, the workpiece may rest on the upper, lower and/or side surfaces of bar 28 as it is being clamped between the clamping jaw members 22 and 24. The evenly cornered or rounded edges of the elongated member 28 allow the clamping jaw members 22 and 24 and the locking arm 26 to slide more easily along the elongated member 28 without potential hang-ups due to the absence of sharp corners between the sides and upper and lower surfaces of the elongated member 28.

Although the I-shape of bar 28 provides an excellent strength to weight ratio, the elongated member 28 may take on different shapes in alternate embodiments. For example, in one form, the elongated member 28 may be a rectangular bar having smooth and generally flat sides. In another form, the elongated member 28 may be a round bar or pipe rather than a generally rectangular or square-shaped bar. In yet other forms, the elongated member 28 may be a round or rectangular shaped hollow beam.

In FIGS. 1A-D, the first clamping jaw member 22 includes a solid body portion 22*a* which defines an aperture 22*b* into which the elongated member 28 may be inserted. The clamping jaw member 22 may be attached or fixed to the elongated member 28 in any way known in the art, such as with adhesives or fasteners like pins, screws, bolts or rivets, in which case there may be small holes in one or both of the sides 22*c-d* of the clamping jaw member 22. Alternatively, and as mentioned above, the clamping jaw member 22 may also be releasably attached to the elongated member 28, such that the clamping jaw member 22 may be connected to the elongate member 28 in a plurality of locations and removed from one side of the elongated member 28 and connected to the opposite side of the elongated member 28 in order to convert the apparatus 20 from its clamp configuration to its spreader configuration.

Figure 3:
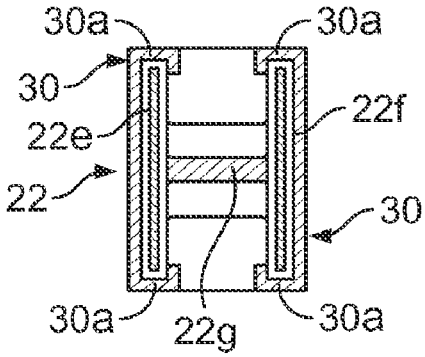
FIG. 3 is a cross-sectional view of the first clamping jaw member of the parallel clamp of FIG. 1A as viewed along line 3-3 of FIG. 1B.

As shown in FIG. 3, the first clamping jaw member 22 has a generally I-shaped cross-section with wider abutment surfaces 22*e* and 22*f* connected to a narrower central support 22*g*. The central support 22*g* may be narrower at the top of the clamping jaw member 22 and wider at the bottom of the clamping jaw member 22 in order to accommodate the aperture 22*b* for the elongated member 28 without weakening the body 22*a* of the clamping jaw member 22. Optionally, the clamping jaw member 22 may also include a jaw pad, such as replaceable jaw covers 30, which cover at least a portion of the abutment surfaces 22*e-f* of the clamping jaw member 22. In the embodiment illustrated, the jaw covers 30 correspond in shape to the shape of the abutment surfaces 22*e-f* and have a bent over (e.g., J- or U-shaped) peripheral rim portion 30*a* (FIGS. 3 and 5A-C) to form a channel at the rear of the pad for receiving the outer lip of one of the abutment surfaces 22*e* and 22*f*. The jaw covers 30 further define an opening 30*b* through which the bar 28 may pass.

In a preferred form, the replaceable jaw covers 30 slide onto the clamping jaw member 22 in a sleeve-like manner and are frictionally fit thereto so that they cannot inadvertently be removed. In alternate embodiments, however, the jaw covers 30 may include projections extending from a surface thereof which are received by mating indentations or recesses in the clamping jaw member 22 when the cover has been placed fully thereon. For example, in one form the covers 30 may have stub portions extending from the inner side surfaces thereof which are received by indentations located in the outer side edges of the abutment surfaces 22*e-f* of the clamping jaw member 22. The projections are preferably malleable and snap into the indentations, thus allowing the jaw covers 30 to be releasably connected to the clamping jaw member 22. In other forms, ball and detent or hook and recess systems may be employed to releasably lock the covers 30 onto the clamping jaw member 22.

The replaceable jaw covers 30 are preferably constructed of plastic, but other materials such as rubber may also be utilized. Furthermore, in the embodiment illustrated, the jaw covers 30 have flat faces, which may be desirable for engaging certain workpieces. In other applications, however, the jaw covers 30 may include additional shapes or patterns for better engaging the work piece. For example, the jaw covers 30 may include faces with curved ribs which are capable of engaging rounded work pieces, such as pipes or tubes, better than flat jaw covers can.

In the embodiment illustrated, the first clamping jaw member 22 is provided with two jaw covers 30 so that the fixed clamping jaw member 22 does not have to be removed or rotated in order to place the apparatus 20 into its spreader configuration. Rather, the second clamping jaw member 24 is removed from the elongated member 28, rotated one hundred eighty degrees (180°), and placed back on the elongated member 28 in order to operate the apparatus 20 in the spreader configuration. In alternate embodiments, the apparatus 20 may be provided with one jaw pad on the first clamping jaw member 22 which can be placed on either abutment surface 22*e* or 22*f* depending on whether the apparatus 20 is setup for a clamping or spreading operation. In yet other embodiments, a single jaw pad may be provided which covers both abutment surfaces 22*e-f* or, as mentioned above, the first clamping jaw member 22 may be removable from the bar 28 so that it may be repositioned thereon to convert the apparatus 20 from its clamp configuration to its spreader configuration.

As will be discussed in further detail below, the clamping jaw member 22 may also include a base or bottom portion and, more preferably, includes an enlarged flat base 32, such that the apparatus 20 may be used in a free-standing form and is stable when rested on a generally flat work surface. The base 32 has a shape which generally compliments the shape and footprint of the bottom portion of the first clamping jaw member 22, and defines a recess within which the bottom portion is inserted. In the form illustrated, the base 32 is rectangular in shape and defines a cup-like recess within which the bottom portion of clamping jaw member 22 is inserted. The base 32 may be retained on the clamping jaw member 22 in a variety of ways, such as with adhesives or fasteners, but in a preferred form is frictionally fit onto the bottom portion of the clamping jaw member 22 so that the base 32 may be removed and replaced, if desired. In one form, the base 32 may also serve to maintain the bar 28 at a height which will allow the second clamping jaw member 24 to be freely movable about the bar 28 when the apparatus is in a free-standing operation.

The second clamping jaw member 24 includes a solid body portion 24*a* which defines an aperture 24*b* for receiving the elongated member 28. The second clamping jaw member 24 is not fixed to the elongated member 28, but rather may freely slide along the elongated member 28. The sliding clamping jaw member 24 also defines a receptacle 24*c* for receiving an end 34*a* of the pressure application member 34. Preferably, the receptacle 24*c* includes a structure for retaining the end 34*a* of the pressure application member 34 therein, such that the end 34*a* can "snap" into the receptacle 24*c* of the sliding clamping jaw member 24 while still being allowed to rotate. For example, in the embodiment illustrated, the receptacle 24*c* defines a socket which captures the ball end 34*a* of the pressure application member 34 and prevents the end 43*a* from being removed from receptacle 24*c* via a ring lock, such as metal ring 25. The ball and socket joint formed by the receptacle 24*c* and end 34*a* allows the pressure application member 34 to be rotated with respect to the clamping jaw member 24 and compensates for any tilting of the arm 26 due to the engagement of the brake mechanism 40.

In alternate embodiments, the joint formed by the receptacle 24*c* and the end 34*a* may allow for the end 34*a* to be removed from the receptacle 24*c* so that maintenance or repair may be made. For example, in one form the receptacle 24*c* may include opposing springs which are biased against each other, or in opposing directions, such that the end 34*a* of the pressure application member 34 depresses the springs as it is inserted into the receptacle 24*c* and then the springs expand into a groove or depression located in from the end 34*a* of the pressure application member 34 after the spherical end 34*a* has passed therebetween. In that way, the end 34*a* of the pressure application member 34 may be releasably connected to the sliding jaw member 24. Thus, should the operator desire to repair or replace any of the parts of the apparatus, such as the sliding jaw member 24, he or she can easily separate the jaw member 24 from the pressure application member 34 and remove the jaw member 24 from the elongated member 28.

Figure 4:
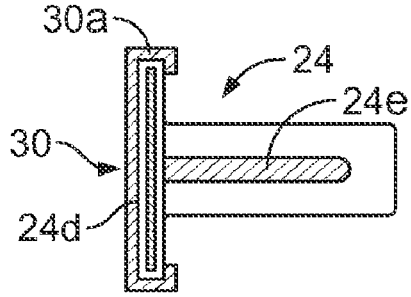
FIG. 4 is a cross-sectional view of the second clamping jaw member of the parallel clamp of FIG. 1A as viewed along line 4-4 of FIG. 1B.
Figure 5A:
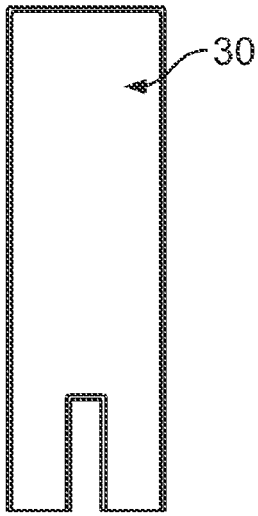
FIGS. 5A-C are front elevational, rear elevational and bottom views, respectively, of one of the jaw pads from FIG. 1A.
Figure 5B:
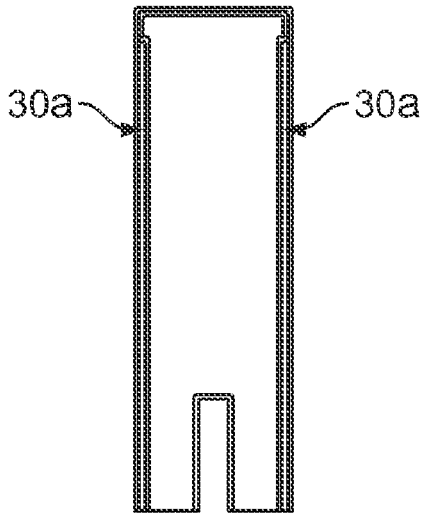
Figure 5C:
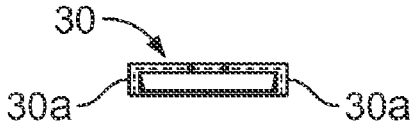

As shown in FIG. 4, the second clamping jaw member 24 has a general T-shaped cross-section with a wider abutment surface 24*d* and a narrower support portion 24*e* which extends from the abutment surface 24*d* like a gusset wall. The support portion 24*e* may be narrower at the top of the sliding clamping jaw member 24 and wider at the bottom of the jaw member 24 in order to accommodate the aperture 24*b* for the elongated member 28 without weakening the support member 24*e* of the jaw member 24. Optionally, the sliding jaw member 24 may also include a jaw pad, such as replaceable jaw cover 30, which covers at least a portion of the abutment surface 24*d* of the sliding jaw member 24. As mentioned above with respect to the first clamping jaw member 22, the jaw cover 30 corresponds in shape to the shape of the abutment surface 24*d* of the second clamping jaw member 24 and has a bent over (e.g., J- or U-shaped) peripheral rim portion 30*a* to form a channel at the rear of the pad for receiving the outer lip of abutment surface 24*d*. Again, however, alternate forms of jaw cover 30 may be provided. For example, in one form the jaw cover 30 may snap into place on the movable clamping jaw member 24, (e.g., one of the movable clamping jaw member 24 and jaw cover 30 may have a projection while the other has a mating recess). In another form, the jaw cover 30 may be provided with faces that are shaped to correspond to specific workpieces to be clamped or spread via the apparatus 20. In yet other forms, the apparatus 20 may be provided without jaw pads entirely, if desired.

Locking arm 26 includes a body portion 26*a* which defines an aperture 26*b* for receiving the elongated member 28 and an aperture 26*c* for receiving the pressure application member 34. The body portion 26*a* also defines a brake release aperture 26*d* (FIG. 2) for receiving the brake release mechanism 40. In the form illustrated in FIGS. 1A-D and 2, the elongate member aperture 26*b* is located near the bottom of the locking arm's body portion 26*a* and, like the other elongate member apertures, defines a rectangular opening which generally corresponds to the shape of the elongated member 28. The pressure application member aperture 26*c* is located near the top of the locking arm's body portion 26*a* and defines an internally threaded bore into which a threaded shaft 34*b* of the pressure application member 34 is disposed. The primary axis of the openings 26*b* and 26*c* are preferably parallel to one anther so that the longitudinal axis of the pressure application member 34 is generally parallel to the longitudinal axis of the elongate member 28. This will help keep the abutment surface 24*d* of second clamping jaw member 24 parallel to the abutment surface 22*f* of first clamping jaw member 22 and keep the second clamping jaw member 24 generally perpendicular to the elongated member 28.

The brake release aperture 26*d* is located between the vertically extending side walls of an angular extension portion that connects the portions of the body defining apertures 26*b* and 26*c*, and intersects the elongate member aperture 26*b* from above. The angular extension portion of arm body 26*a* has a U-shaped cross section and defines a recess within which the brake release mechanism may travel. In a preferred form, the body 26*a* of the locking arm 26 corresponds in shape to that of the sliding jaw member 24, and has a bottom portion that is wider than the top portion. It should be understood, however, that the arm 26 (as well as the first and second clamping jaw members 22 and 24) may have a plurality of different shapes and sizes. For example, an alternate form of arm 26 may comprise a generally vertical bar, rather than an angled bar as illustrated in FIGS. 1A-D and 2.

In the embodiment illustrated, the base or bottom portion of locking arm body portion 26*a* includes legs 26*e* and 26*f* which extend down below the elongated member aperture 26*b*. The bottom surfaces of legs 26*e* and 26*f* are preferably within the same plane as the bottom surface of the base 32 of first clamping jaw member 22 and provide additional support to the apparatus 20 when used in a free standing manner. In alternate embodiments, however, the bottom surfaces of legs 26*e-f* may not be coplanar with the bottom surface of base 32 if, for example, it is desired to provide clearance between the work surface and the legs 26*e-f* so that the arm 26 and second clamping jaw member 24 may more easily be moved along the elongated member 28.

The brake release mechanism 40 preferably includes a brake lever 42 operable to release a brake plate 44 coupled to the locking arm 26 such that the position of the locking arm 26, as well as the sliding jaw member 24, can be adjusted to a plurality of positions on the elongated member 28. In the form illustrated in FIGS. 1A-D and 2, the brake release lever 42 includes a first brake release lever 42*a* and a second brake release lever 42*b*, which are formed from a single piece of metal and define an aperture therebetween through which the elongated member 28 is disposed. The first lever 42*a* extends generally horizontally above the elongated member 28 and preferably parallel thereto, while the second lever 42*b* extends generally vertically below the elongated member 28 and preferably at an angle other than ninety degrees (90°) thereto. In the form illustrated, the second lever 42*b* is at an angle slightly less than ninety degrees (90°) to the elongate member to provide the user with room to reach in and actuate the lever 42*b*.

The brake release lever 42, including levers 42*a* and 42*b*, is movable between a first position wherein the brake plate 44 remains in a brake engaged position preventing the arm 26, and sliding jaw member 24 which is connected thereto, from moving with respect to the elongated bar 28, and a second position wherein the brake plate 44 is shifted to a brake release position wherein the arm 26 and sliding jaw member 24 are freely movable with respect to the elongated member 28. More particularly, in the embodiment illustrated, the portion of the brake release lever 42 extending between the first and second levers 42*a* and 42*b* abuts the brake plate 44 so that movement of the release lever 42 between the first and second position results in a corresponding movement of the brake plate 44 between brake engaged and brake released positions, respectively. This portion further defines the aperture through which the elongated member 28 is disposed.

The brake is preferably in the form of a slotted plate 44 having a central slot opening 44*a* through which the elongated member 28 extends. Normally, the plate 44 is biased by a spring, such as leaf spring 46, into tight angular engagement with the elongated member 28 at the upper and lower edges defined by the slot 44*a*. This bias causes the plate 44 to exert a frictional force against the elongated member 28 and locks or holds the locking arm 26 in place on the elongated member 28. To this end, the slot 44*a* is configured to be larger than the elongated member 28 such that when in braking engagement therewith, the plate 44 is extending at other than a perpendicular angle to the longitudinal axis of the elongated member 28 so that the play between the larger slot 44*a* and the elongated member 28 is taken up.

As shown, the plate 44 is inclined so that the lower edge is closer to the sliding jaw member 24 than the upper edge. The non-perpendicular orientation is such that the frictional force applied to the elongated member 28 by the plate 44 only limits the locking arm 26 from moving along the elongated member 28 in a direction in which it is inclined and does not limit the movement of the locking arm 26 in a direction opposite to that in which the plate 44 is inclined. In this way, the locking arm 26 can slide along the elongated member 28 in a direction in which the sliding jaw member 24 is in front of and is leading the locking arm 26 even when the brake release mechanism 40 remains in its normally biased or brake engaged position, but cannot slide along the elongated member 28 in the opposite direction unless the brake release mechanism 40 is actuated or moved to the brake release position.

The brake release lever 42 is preferably a user operated portion which includes the first brake release lever 42*a* and second brake release lever 42*b*. In the form illustrated and as mentioned briefly above, the first brake release lever 42*a* is located between the elongated member 28 and the pressure application member 34, such that the user may conveniently actuate the lever 42*a* while still gripping the pressure application member 34, such as with the user's thumb and palm of the user's hand on the pressure application member 34 and the user's fingers on the brake release lever 42. The brake release lever 42 may also include a handle grip 48 which is contoured to comfortably receive the user's fingers when the user operates the first brake release lever 42*a*. The handle grip 48 may also include a finger support 48*a* so that the user may position a finger at the front of the grip 48 to simplify the actuation of the brake release lever 42.

The grip 48 is preferably made of molded plastic, but may be made of a variety of other materials, such as rubber and/or wood, which are capable of assisting the user in comfortably gripping the brake releasing lever 42. The handle grip 48 may also include an overmolding such as ribbed portion 48*b*. In the embodiment illustrated, the overmolded portion 48*b* includes an elastomer overmolding located on the lower surface of the handle grip 48 proximate to the finger support 48*a*. The elastomer overmolding portion 48*b* is preferably added by way of an injection overmolding process which is conducted after the initial molding of the handle grip 48.

A preferred material for the elastomer overmolding portion 48*b* is an elastomer/plastic blend, such as, for example, SANTOPRENE, which is a product of Advanced Elastomer Systems, L.P. of Akron, Ohio. The overmolding portion 48*b* may be formed with a smooth outer surface or with a textured outer surface and provides a non-slip rubber (or rubber-like) gripping surface for the operator's hand to grasp. In alternate embodiments, additional portions (or the entire surfaces) of the brake release lever 42 and pressure application member 34 may be covered with an elastomer overmolding. It should also be understood that other materials may be used for the overmolding portions. For example, other thermal plastic elastomers or elastomer/plastic blends, such as rubber, nylon, butyl, EPDM, poly-trans-pentenarmer, natural rubber, butadiene rubber, SBR, ethylene-vinyl acetate rubber, acrylate rubber, chlorinated polyethylene, neoprene and nitrile rubber, may also be used for the overmolding. Another material which may be used for the overmolding is HERCUPRENE, which is manufactured by the J-Von Company of Leominster, Mass.

In yet other embodiments, no overmolding may be provided whatsoever. For example, the handle grip 48 may be provided with a simple smooth plastic finish, or with a textured finish created from the plastic injection molding process. In one form, the overmolding may be replaced with a textured surface, such as Rawal #MT-11605, a mold texturization process provided by Mold-Tech/Rawal of Carol Stream, Ill. Similarly, other mold texturization processes may be used to create a variety of textured surfaces.

The second brake release lever 42*b* is preferably located on the opposite side of the elongated member 28 from the first brake release lever 42*a*, such that the user may actuate the second brake release lever 42*b* in instances when using the first brake release lever 42*a* may not be convenient, such as when the apparatus 20 is secured to a workpiece in an inverted position or in a hard to reach corner of the workspace. In the form illustrated, the second brake release lever 42*b* extends down from the elongate member 28 between legs 26*e-f* of arm body 26. The legs 26*e-f* are preferably spaced apart a sufficient amount in order to provide a user with ample space to reach and operate the second brake release lever 42*b*, such as for example, with the user's thumb or other fingers.

The brake release lever 42 is pivotally mounted to project through the brake release aperture 26*d* of the locking arm 26. The actuation of the first or second brake release levers 42*a-b* causes the brake release lever 42 to pivot about its pivot axis and against the slotted plate 44. The slotted plate 44 will then tilt against its bias into a more upright, or more perpendicular, position relative to the longitudinal axis of the elongated member 28. That is, the pivoting of the brake release lever 42 causes the slotted plate 44 to move from a position of angular engagement with the elongated portion 28 to a more upright, generally disengaged position with the elongated member 28. While in this more upright position, the locking arm 26 is capable of freely moving along the elongated member 28 because the brake plate 44 is no longer in frictional engagement with the elongated member 28.

In other words, the actuation of the brake release mechanism 40 tilts the slotted plate 44 so that the slot 44*a* is in clearance with the elongated member 28 and so that the elongated member 28 may slide therethrough. In this manner, when a user grips and actuates the first or second brake release levers 42*a-b*, the user may slide the locking arm 26, and the second clamping jaw member 24 which is connected thereto, along the elongated member 28 in either direction. Once the brake release lever 42 is released, the brake 44 returns to its original position in angular engagement with the elongated member 28 and the frictional engagement created thereby limits the locking arm 26 and second clamping jaw member 24 from moving along the elongated member 28 in a direction in which the slotted plate 44 is inclined.

Figure 2:
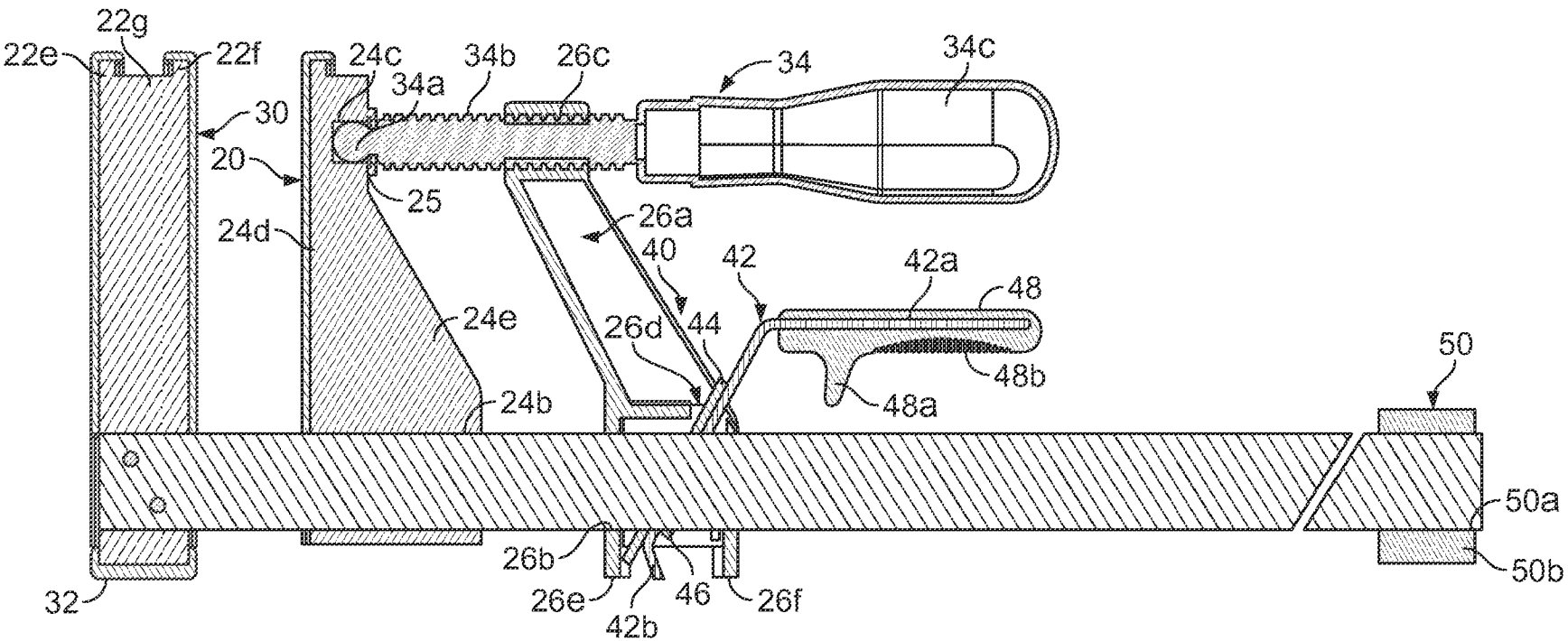
FIG. 2 is a cross-sectional view of the parallel clamp of FIG. 1A as viewed along the longitudinal access of the parallel clamp denoted by line 2-2 of FIG. 1C.

The pressure application member 34 includes the end portion 34*a*, a threaded portion 34*b*, and a body 34*c*. In FIG. 2, the end portion 34*a* is illustrated as having a roughly spherical shape which allows the pressure application member 34 to more easily rotate with respect to the second jaw member 24, and can account for tilting of the arm 26 due to the braking mechanism's engagement of the elongated member 28. It should be understood, however, that the end 34*a* may take a number of different shapes if desired. The threaded portion 34*b* of the pressure application member 34 includes a threaded shaft or spindle having external threads which correspond to and may be received by internal threads of the aperture 26*c* of locking arm 26. Thus, the pressure application member 34 may be received and threaded through the aperture 26*c* of the locking arm 26 and then received by the receptacle 24*c* of the sliding clamping jaw member 24.

In the embodiment illustrated, the body 34*c* is in the form of a handle having an enlarged or bulbous end portion which allows the user to readily grab and actuate the pressure application member 34. The handle tapers toward the threaded shaft portion 34*b* of the application member 34 in order to provide users with a variety of handle sizes or diameters to accommodate differing hand sizes. It should be understood, however, that the body 34*c* may take any other form which allows the user to easily actuate the pressure application member 34, such as a flat-sided or knurled head, slotted T-bar or T-shaped handle, L-shaped handle, transverse rod, crank, handwheel, ratchet handle, or the like. The body 34*c* is preferably made of plastic, but other materials, such as wood, may also be utilized. Additional texture or gripping may be added to the body 34 in a manner similar to that of the brake release lever 42 and handle grip 48 discussed above, if desired. The body 34*c* is securely attached to the threaded portion 34*b* such that the body 34*c* and the threaded portion 34*b* may be actuated or twisted together as one piece. In alternate forms, the handle 34*c* and shaft 34*b* may be made of an integral piece of material if desired.

The apparatus 20 may secure a workpiece through the operation of the locking arm 26 and sliding clamping jaw 24. When in the clamping configuration, the workpiece is placed between the first clamping jaw member 22 and the second clamping jaw member 24, and may be supported by one of the surfaces of the elongated member 28. The locking arm 26 and sliding clamping jaw member 24 are then moved along the elongated member 28 until the abutment surface 24*d* (or pad 30 if thereon) of the sliding clamping jaw member 24 contacts the workpiece. The braking mechanism 40 locks the locking arm 26 into place on the elongated member 28, such that the locking arm 26 cannot be moved away from the workpiece without actuating either the first brake release lever 42*a* or the second release lever 42*b*. When the locking arm 26 is locked into place on the elongated member 28 by the brake 44, the pressure application member 34 may then be actuated, twisted, or further threaded through the aperture 26*c* of the locking arm 26 in order to cause the sliding clamping jaw member 24 to be shifted toward and apply pressure to a workpiece, such that the apparatus may secure the workpiece between the abutment surfaces 22*f* and 24*d* of first and second clamping jaw member 22 and 24, respectively.

The sliding jaw member 24 and locking arm 26 causes pressure application member 34 to move the sliding jaw member 24 along the elongated member 28 such that the abutment surface 24*d* is substantially parallel with the abutment surface 22*f* of clamping jaw member 22. Thus, the abutment surface 24*d* of sliding clamping jaw member 24 is maintained generally perpendicular to the bar 18 and the jaw members 22 and 24 can remain flush against the workpiece. With this configuration, the pressure applied through the pressure application member 34 will be spread over the entire contact surface between the workpiece and the apparatus 20. The workpiece may then be released from the apparatus 20 by reversing the pressure application member 34 to remove pressure on the workpiece and by actuating the brake mechanism 40 so that the second clamping jaw member 24 and the locking arm 26 may be moved away from the workpiece, thereby disengaging or releasing the workpiece.

In a preferred embodiment, the construction of the first and second clamping jaw members 22 and 24 and arm 26 is such that they allow the apparatus to be converted between clamp and spreader configurations. In one form, the first clamping jaw member 22 may be removed from one end of the elongate member 28 and reconnected to the opposite end of the elongated member 28 in order to facilitate the conversion of the apparatus 20 from its clamping mode to its spreader mode, as is illustrated in U.S. patent application Ser. Nos. 10/189,938 filed Jul. 3, 2002 and 10/348,162 filed Jan. 21, 2003, which are hereby incorporated herein by reference in their entirety. In this embodiment, the second jaw member 24 may or may not be removable from the elongate member 28. In another form, however, the first jaw member 22 may remain fixed on the elongate member 28 and the second jaw member 24 and arm 26 may be removed from the elongate member 28 and replaced thereon facing the opposite direction in order to facilitate the conversion of the apparatus 20 from its clamping mode to its spreader mode.

Figure 6:
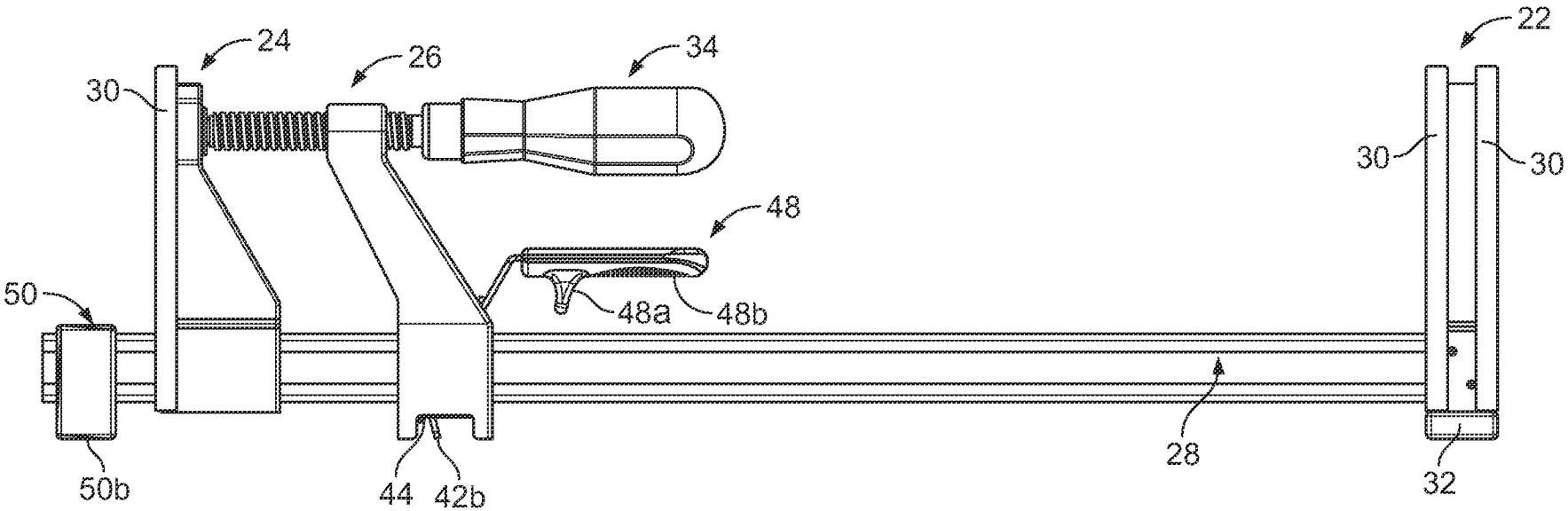
FIG. 6 is a side elevational view of the parallel clamp of FIG. 1A when in its spreader configuration.

In the embodiment illustrated in FIGS. 1A-D, 2 and 6, the first clamping jaw member 22 is removable from the elongated member 28 and replaceable on the opposite end thereof to convert the apparatus from the clamp configuration (FIGS. 1A-D and 2) to the spreader configuration (FIG. 6). The elongated member 28 also has stops located on each end of the bar to prevent the second clamping jaw member 24 and locking arm 26 from being removed from the elongate member 28. By preventing the removal of the second jaw member 24 and locking arm 26 from elongate member 28, there is no need to ensure that the braking mechanism components will retain their position when the jaw member 24 and arm 26 are removed from the elongate member 28. In fact, the removal of these components from the bar, as configured in FIGS. 1A-D, 2 and 6, may result in certain components, such as brake release lever 42, brake plate 44, spring 46, and their respective apertures, shifting out of alignment so as to make it difficult, if not impossible, to replace the second jaw member 24 and arm 26 on the elongate member 28.

The first clamping jaw member 22 is preferably secured or fixed to the elongated member 28 via fasteners, such as set screws, which are screwed into internally threaded openings defined by the first clamping jaw member 22. Thus, the fasteners may be loosened so that the first clamping jaw member 22 may be removed from one end of the elongated member 28 and placed on the opposite end thereof. Once replaced, the first jaw member 22 may again be fastened to the elongated member 28 via the fasteners.

The apparatus 20 also includes a stop 50 which is located on the elongated member 28 on the side opposite the first clamping jaw member 22. The stop 50 inhibits the second jaw member 24 from being removed from the other side of the elongate member 28. When converting the apparatus 20 from its clamping configuration to its spreader configuration, the stop 50 may either be removed entirely from the elongate member 28 or swapped with the first clamping jaw member 22 (as illustrated in FIG. 6).

In the form illustrated, the stop 50 is rectangular in shape and defines a generally rectangular aperture 50*a* within which the elongate member 28 is disposed. The stop 50 may be connected to the end of the elongate member 28 in a plurality of ways, including the use of adhesives or fasteners, such as screws, bolts, pins, rivets, or the like, but is preferably connected via a frictional engagement between the stop 50 and the elongated member 28 so that the stop 50 may be readily removed and swapped if desired. The stop 50 further includes a bottom portion or base 50*b* which maintains the height of the elongated member 28 so that it will remain generally parallel to a flat work surface. More particularly, the bottom surface of the stop base 50*b* is preferably in the same plane as the bottom surfaces of the first jaw member base 32 and the legs 26*e-f* of arm 26 to support the apparatus 20 during freestanding operation. Again, however, the bottom surfaces of legs 26*e-f* do not need to be made coplanar with the bottom surfaces of stop base 50*b* and first jaw member base 32 if, for example, it is desired to provide clearance between the work surface and the legs 26*e-f* so that the arm 26 and second clamping jaw member 24 may more easily be moved along the elongated member 28.

In other embodiments, the stop 50 may simply be a projecting member, such as a rivet, which forms an obstruction that prevents the second clamp member 24 from being removed from the elongated member 28. In this configuration, the first clamping jaw member 22 may be provided with an opening sufficient to allow the clamping jaw member 22 to clear the stop 50 and therefore be removed from the elongated member 28. The second clamping jaw member 24 and arm 26, however, would not be provided with such a clearance and would be prevented from being removed from the elongated member 28. This allows the first clamping jaw member 22 to be relocated to the opposite end of the elongated member 28 so that the apparatus 20 may be converted between its clamping mode (FIGS. 1A-D and 2) and its spreader mode (FIG. 6). Although there would be no stop portion such as 50*b* to maintain the height of the elongated member 28, the bottom surface of the first clamp member 22 could be made coplanar with the bottom surface of legs 26*e-f* and/or the bottom surface of the second clamp member 26 so that the apparatus could continue to be used in a freestanding manner.

Figure 7A:
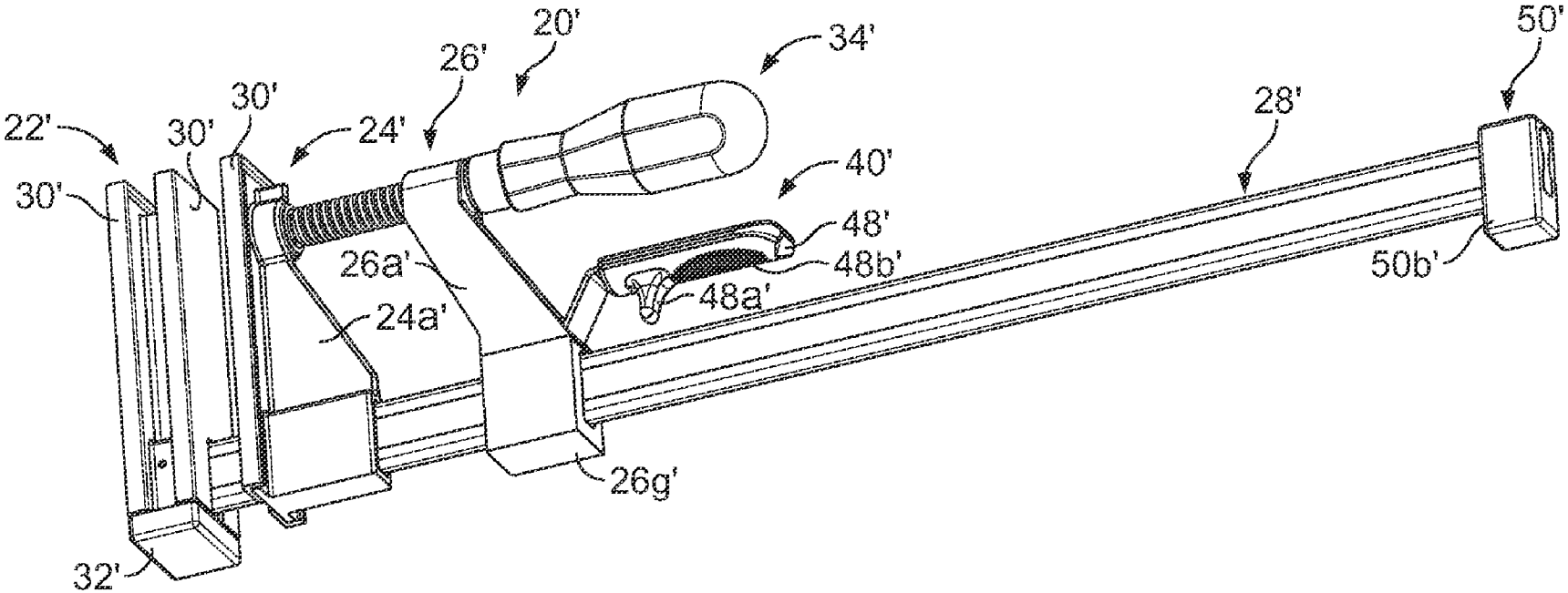
FIG. 7A is a perspective view of an alternate parallel clamp having an arm member with an enclosed based and embodying other features of the present invention.
Figure 7B:
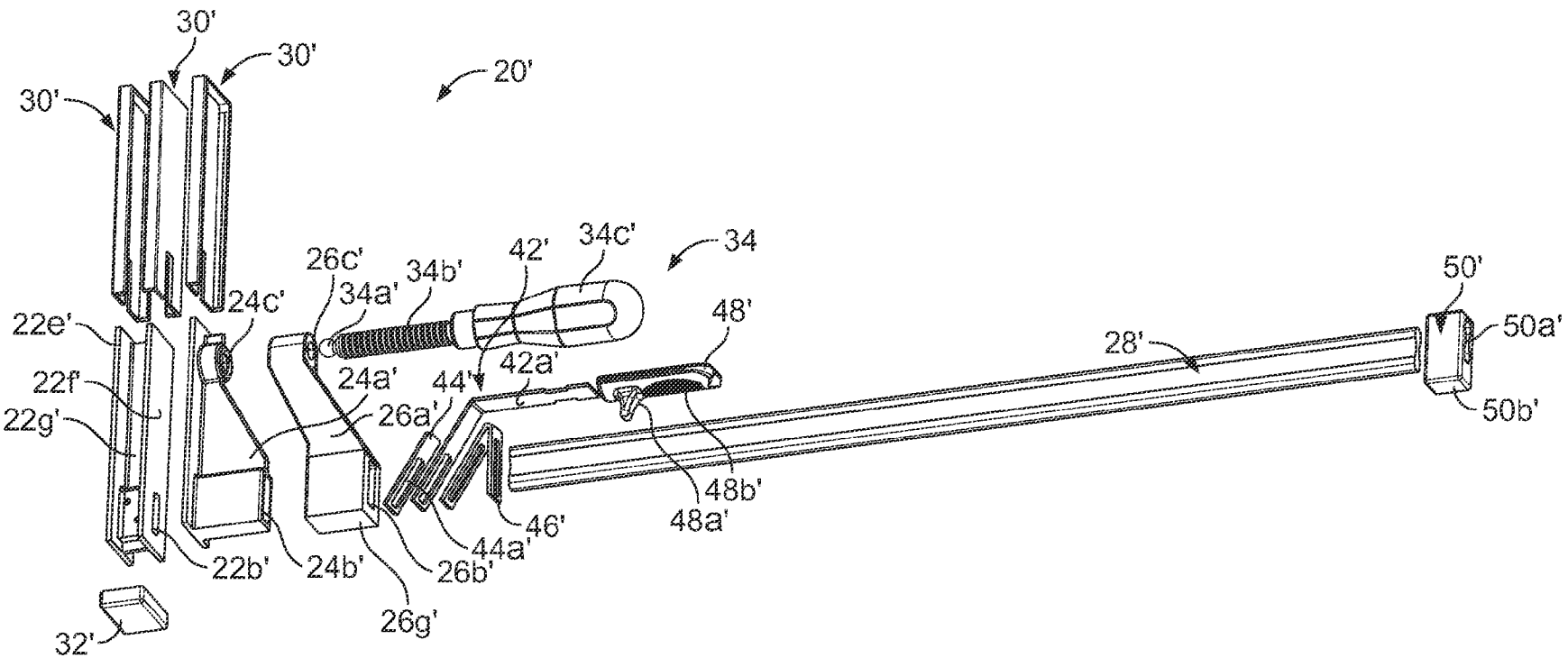
FIG. 7B is an exploded perspective view of the parallel clamp of FIG. 7A illustrating the internal components of the braking mechanism.
Figure 8:
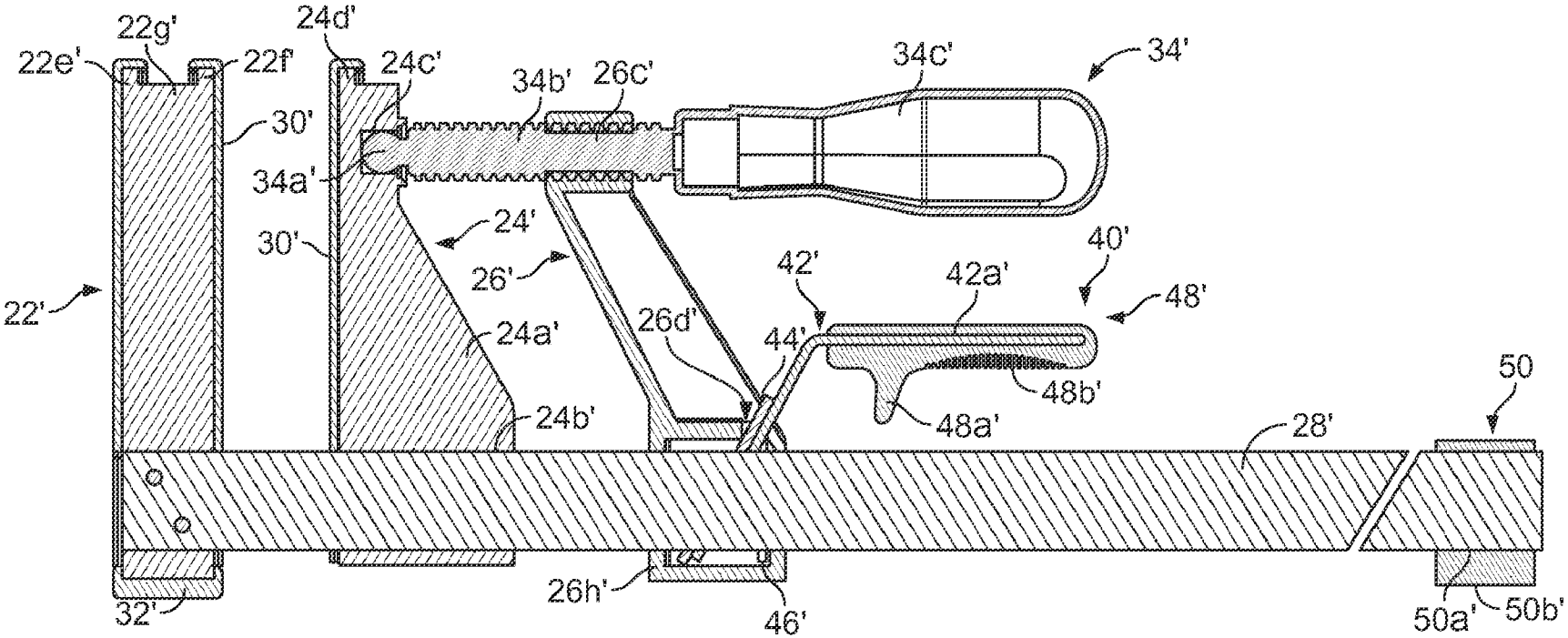
FIG. 8 is a cross-sectional view of the parallel clamp of FIG. 7A as viewed along the longitudinal access of the parallel clamp.

In yet other embodiments, both clamp members 22 and 24 may be removable from the elongated member 28. An example of one such embodiment is illustrated in FIGS. 7A-B and 8. For convenience, items which are similar to those discussed above will be identified using the same reference numeral in combination with an apostrophe (') merely to distinguish one embodiment from the other. In the embodiment illustrated in FIGS. 7A-B and 8, the sliding clamping jaw member 24' and the locking arm 26' may be fully removed from the elongated member 28'. The jaw member 24' and locking arm 26' are coupled to one another by the pressure application member 34' and the locking arm 26' is provided with a fully enclosed base 26*g'* which keeps the brake release lever 42', brake plate 44' and spring 46' (and their respective apertures), aligned while the sliding jaw member 24' and locking arm 26' are removed from the elongated member 28'. More particularly, the enclosed base 26*g'* prevents the brake release lever 42', brake plate 44' and spring 46' from falling out of the arm 26' and/or out of alignment with one another. Since the base is totally enclosed in this particular embodiment, a second brake release lever is not provided. In alternate embodiments, however, a second brake release lever may be provided, such as through a slot in the otherwise enclosed base.

In operation, the sliding jaw member 24' and arm 26' are removed from the elongated member 28 by removing the stop 50' (if any) and slightly actuating the brake release mechanism 40' to pivot the brake plate 44' out of frictional engagement with the elongated member 28' so that the jaw member 24' and arm 26' may be slid off the end of the elongated member 28'. The spring 46' exerts pressure against the brake release lever 42' and the brake plate 44', such that when the elongated member 28' is removed the spring 46' biases the brake release lever 42' and the brake plate 44' against a side wall 26*h'* of the locking arm 26'. The jaw member 24' and arm 26' may then be rotated to face in the opposite direction and replaced back on the elongated member 28' by sliding the jaw member 24' and arm 26' back onto the elongated member 28'. Preferably, the brake release lever 42', brake plate 44' and spring 46' will remain in alignment, such that the locking arm 26' may be reconnected to the elongated member without any adjustment of the brake release lever 42' and the brake plate 44', but in some cases it may be necessary to make slight adjustments to the position of these components and/or the elongated member 28' in order to bring them back into alignment and allow the locking arm 26' to be reconnected to the elongated member 28'. For example, it may be necessary to slightly actuate the brake release mechanism 40' in order to align the brake lever 42', brake plate 44' and spring 46' so that the locking arm 26' can be placed back on the elongate member 28'. In this manner, the brake release lever 42', brake plate 44', and spring 46' are captured within the enclosed base 26*g'* so that the apparatus 20' may be converted between its clamp and spreader configurations.

As mentioned above, the bottom surfaces of the second clamp member 24' and arm 26' may be made coplanar with the bottom surfaces of the first clamping jaw member 22' and the stop 50' to provide additional support to the apparatus 20' when in freestanding operation. Alternatively, however, the bottom surfaces of the second jaw member 24' and arm 26' may be designed so that they are not coplanar with the bottom surfaces of the first clamp member 22' (or its base 32') and the stop 50' if, for example, it is desired to provide clearance between the work surface and the sliding clamp member 24' and arm 26' to allow these components to move more easily along the elongated member 28'.

While it is preferred that the enclosed base 22*g'* be used to capture the brake release lever 42', the brake plate 44', and the spring 46' in this alternative apparatus, other designs and structures may be used to capture and align the brake release lever 42', brake plate 44', and spring 46' as well. For example, the position and alignment of these components may be maintained via guides or ribs such as those disclosed in U.S. patent application Ser. No. 10/348,162 filed Jan. 21, 2003, which is hereby incorporated herein by reference in its entirety.

Figure 9A:
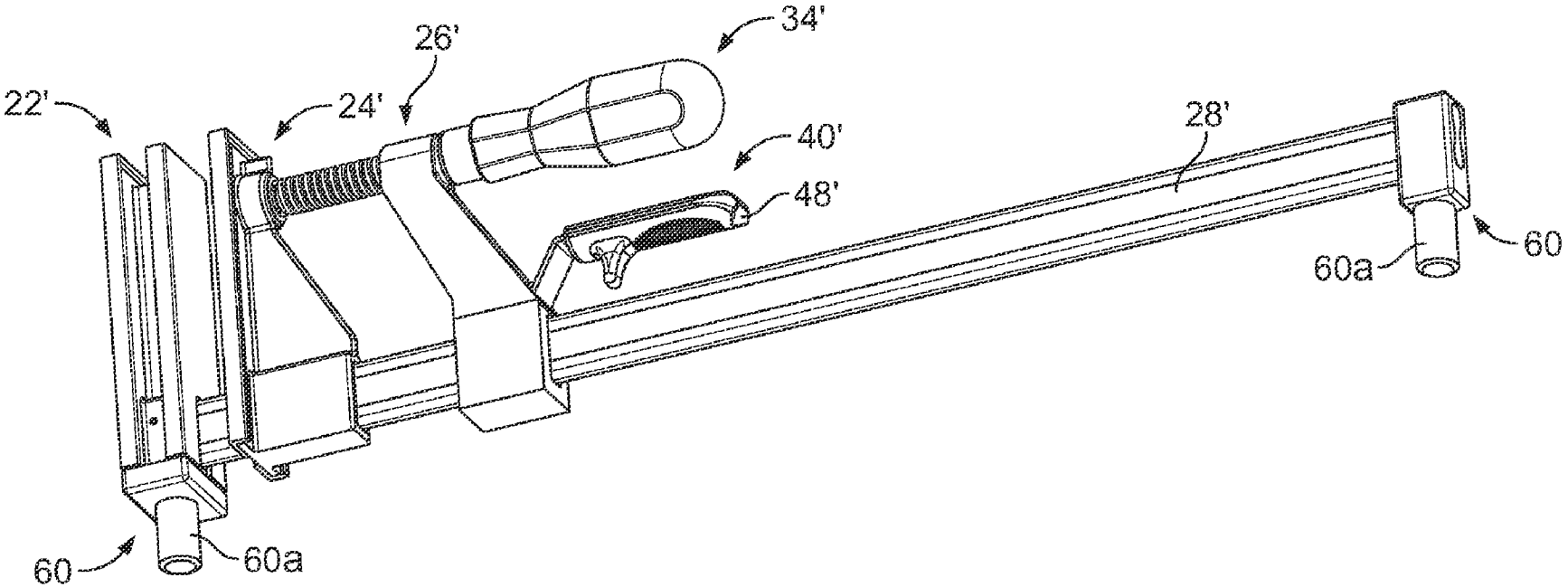
FIGS. 9A-B are perspective and exploded views, respectively, of an alternate parallel clamp having accessories for securing the clamp to a work surface.
Figure 9B:
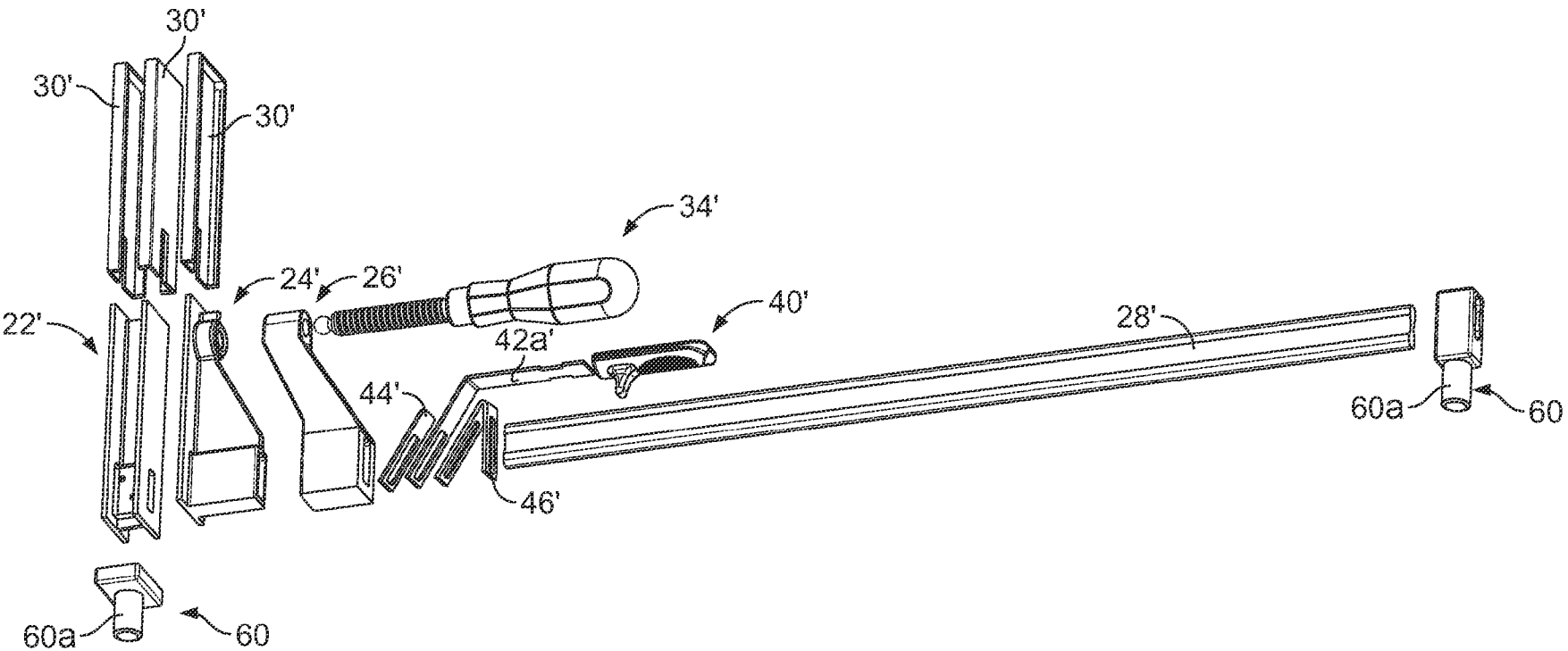

The apparatus may also include structures for connecting the clamp to specific types of work surfaces. For example, the apparatus may have a structure for mating with a corresponding structure on a work surface so that the apparatus may be connected thereto while maintaining the ability to secure a workpiece in either the clamp or spreader configuration. In the embodiment illustrated in FIGS. 9A-B, the apparatus 20' from FIGS. 7A-B and 8 includes bench dog accessories 60 having at least one protrusion, such as peg 60*a*, for mating with corresponding apertures located on the work surface so that the apparatus 20' can secure a workpiece in a desired manner while being connected to the work surface. In a preferred form, the base 32' and stop 50' (FIGS. 7A-B and 8) are replaced with a new base and stop having integral pegs 60*a* extending therefrom. Thus, the bench dogs 60 may be offered as accessories which can replace the standard base 32' and stop 50' when the operator desires to attach the apparatus 20' to a work surface. For example, the bench dog accessories 60 may be connected to the apparatus 20' so that it, in turn, can be connected to a bench top or table top having mating openings for receiving the peg portions 60*a* of the bench dogs 60. Once the user no longer desires to use the bench dog attachments 60 with the apparatus 20', the base and stop with pegs 60*a* may be replaced with the standard base 32' and stop 50' of FIGS. 7A-B and 8.

Figure 10:
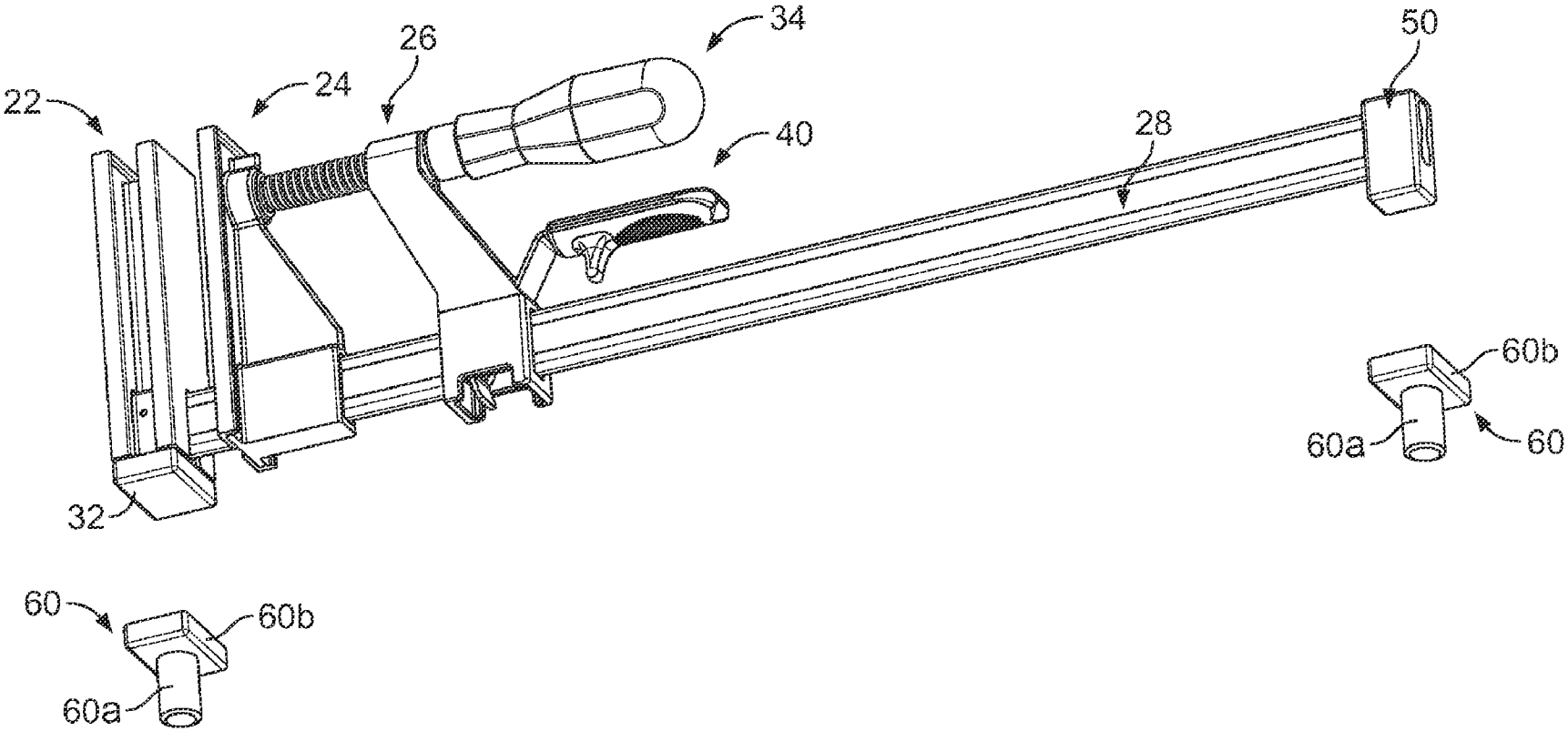
FIG. 10 is a partially exploded perspective view of another parallel clamp having alternate accessories for securing the clamp to a work surface.
Figure 11:
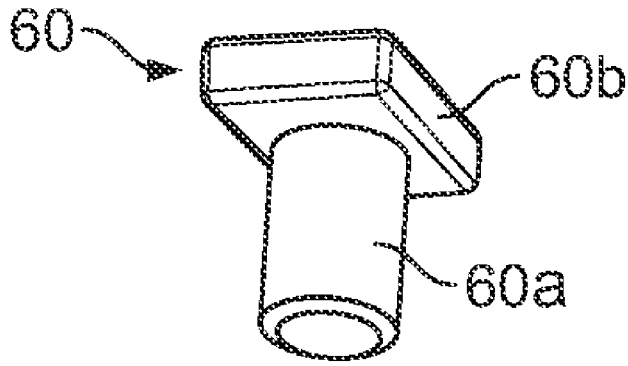
FIG. 11 is a perspective view of an accessory for securing a bar clamp to a work surface.

In alternate embodiments, the bench dogs may be formed as separate components which are to be attached to, rather than swapped with, the existing structure of the apparatus. For example, in FIG. 10, bench dogs 60 are shown attached to the base 32 and stop 50 of the apparatus 20 illustrated in FIGS. 1A-D and 2. The bench dogs 60 have an upper portion 60*b* (FIG. 11) which forms a sleeve or receptacle for receiving the base 32 of first jaw member 22 and the bottom of stop 50. The bench dogs 60 further include pegs 60*a* extending from the sleeve 60*b* which are sized such that they may be received by openings located in a work surface, such as bench dog holes in a workbench or table top. The sleeve portions 60*b* may take any form which allows the bench dog 60 to be releasably attached to the apparatus 20, however, in a preferred form, the bench dogs 60 correspond in shape to the base 32 and stop 50. Thus, the bench dogs 60 are generally rectangular in cross section and are frictionally fit onto the base 32 and stop 50 in order to prevent inadvertent removal of the bench dogs 60 from the apparatus 20.

In the embodiment illustrated, the bottom surface of the peg 60*a* and bottom surface of the sleeve 60*b* (surrounding the peg) preferably form generally flat surfaces which the apparatus 20 may use in a freestanding manner, if need be. More particularly, the flat bottom surfaces of the sleeve 60*b* and peg 60*a* will preferably abut the work surface and allow the apparatus 20 to remain stable and balanced even when the hole which receives the peg portion 60*a* of the bench dog 60 is of a larger size than the peg itself. The bottom surfaces of the second clamping jaw member 24 and/or locking arm 26 may also be made coplanar with the bottom surfaces of the bench dog sleeve 60*b* in order to provide additional stability.

Figure 12:
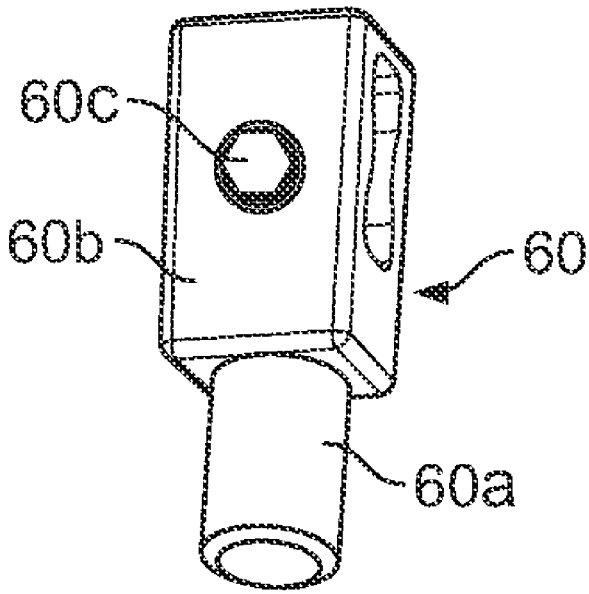
FIG. 12 is a perspective view of an alternate accessory for securing a bar clamp to a work surface and illustrating a type of fastener for securing the attachment thereto.

In the embodiments illustrated in FIGS. 9A-B and 10-11, the bench dogs 60 are injection molded pieces made of plastic or rubber which are frictionally fit onto the apparatus so that they may be readily attached and removed as desired. In alternate embodiments, the bench dogs 60 may be connected or secured to the apparatus in a variety of different manners. For example, in FIG. 12 an alternate embodiment of a stop with a peg portion 60*a* is illustrated which can be fastened to the elongated member 28 via a set screw 60*c*. In other forms, a ball and detent configuration may be used wherein at least one of the apparatus members and bench dogs has a spring biased ball member partially protruding from a surface thereof and the other of the apparatus members and bench dogs has a detent for receiving the ball. Once the ball has rested in the detent, the user will know that the bench dog accessory has been fully installed on the apparatus member. Alternatively, the bench dogs may be connected to existing bar clamps and parallel clamps via adhesives, fasteners, or mating members such as interlocking clips and recesses. For example, the sleeve may include projections which snap into indentations in the corresponding apparatus members (e.g., base 32, stop 50, etc.), such that the bench dogs are releasably attached thereto.

In yet other embodiments, the bench dogs 60 may be permanent fixtures on a bar clamp or a parallel clamp which is specifically intended to be connected to a work surface, such as a bench top, when in use. For example, if the apparatus is solely meant to be connected to a workbench having notches for receiving such protrusions, the bench dogs 60 may be permanently fixed or integral to the apparatus, rather than being accessories to be attached thereto when desired. Regardless of the method in which the bench dogs are connected to the apparatus, however, it is preferred that the stop member and bench dog associated therewith remain freely movable about the elongated member in order to allow the distance between the bench dogs to be adjusted to correspond to the distances between the mating apertures on the work surface.

Although the embodiments illustrated thus far depict the bench dogs as having smooth cylindrical protrusions, it should be understood that alternate embodiments may use any number of shapes or structures capable of mating the apparatus to a work surface. For example, the bench dogs 60 may alternatively be shaped as rectangular columns or include ribbed surfaces for increasing the frictional engagement used to secure the apparatus to the work surface. In another example, the bench dogs 60 or mating recess may have a spring biased ball projection which is retracted or depressed, compressing the spring, when the peg portion of the bench dog is inserted into its mating recess. The projection frictionally engages a surface of either the mating recess or the bench dog and assists in maintaining the bench dog in the recess.

In alternate embodiments, the bench dogs 60 and their mating recesses may include a ball and detent configuration wherein one of the bench dog and mating recesses has a protrusion projecting from a surface thereof and the other of the bench dog and mating recesses has a detent for receiving at least a portion of the protrusion to secure the bench dog 60 (and apparatus connected thereto) to the work surface. For example, in one form the peg portion of the bench dog may have a spring biased ball projecting laterally from a surface thereof and the recess located in the work surface may have a detent for receiving at least a portion of the spring biased ball to secure the bench dog to the recess. In another form, the structures may be reversed so that the work surface has one or more projections and the apparatus has mating recesses for receiving the projections. Regardless of the actual configuration, however, the structures chosen will preferably provide the user with mating structures that can be rapidly connected and disconnected so that the apparatus can be easily attached to and removed from the work surface. It should also be understood that the bench dogs may be used on any type of bar clamp including those which are not parallel clamps.

Another form of the apparatus is illustrated in FIGS. 13A-D. For convenience, items in this embodiment which are similar to items discussed above will be identified using the same reference numeral in combination with the prefix "1" merely to distinguish the embodiments. Thus, the apparatus 120 includes a first clamping jaw member 122, a second clamping jaw member 124, a locking arm 126 and an elongated member 128 to which the first and second clamping jaw members 122 and 124 and locking arm 126 are adjustably mounted to clamp or spread workpieces.

As with the first clamping jaw members discussed above, the first clamping jaw member 122 is preferably fixed to the elongated member 128 and has a body 122*a* having a generally I-shaped cross section with wider abutment surfaces 122*e* and 122*f* connected to a narrower central support 122*g*. Rather than having a solid body, however, the body 122*a* of the first clamping jaw member 122 includes a plastic clam shell housing 122*m* with a metal insert 122*n*. The clam shell housing halves connect to form a parting line 122*p* about which the body 122*a* is symmetrical. Both the clam shell housing 122*m* and the metal insert 122*n* define apertures through which the elongated member 128 may be inserted. Although the jaw member 122 is illustrated without any jaw covers, it should be understood that either (or both) of the abutment surfaces 122*e-f* may be covered with such a jaw pad or pads if desired.

The body 124*a* includes an abutment surface 124*d* for engaging a workpiece and defines a receptacle 124*c* for receiving an end of the pressure application member 134. However, unlike the embodiments discussed thus far, the body 124*a* has a plastic outer body which forms a clam shell housing 124*m* about a metal insert 124*n*. The clam shell housing 124*m* of body 124*a* also extends along the elongated member 128 and around at least a portion of the locking arm 126. More particularly, the clam shell housing 124*m* forms a compartment, such as pocket 124*r*, within which the locking arm 126 is disposed. Thus, the locking arm 126 rides in the housing 124*m* as the second clamping jaw member 124 and arm 126 are moved along the elongated member 128.

Both the clam shell housing 124*m* and the metal insert 124*n* define apertures through which the elongated member 128 may be inserted. In the earlier embodiments of the apparatus, the length of the apertures defined by the clamping jaw members and locking arm helped maintain the jaw members parallel to one another and generally perpendicular to the elongated member. In this embodiment, however, the second clamping jaw member 124 uses the two separate apertures defined by the clam shell outer housing 124*m* and pins 125 to maintain the second clamping jaw member 124 parallel to the first clamping jaw member 122 and generally perpendicular to the elongated member 128. These apertures may be reinforced via the metal insert 124*n* and an additional support, such as metal plate 124*s*, to further help in this regard. In a preferred form, the support plates 124*n* and 124*s* have pins 125 which capture the elongated member 128 and maintain the second jaw member 124 parallel to the first jaw member 122 and perpendicular to the elongated member 128. In the form illustrated, the pins 125 rotate with respect to the rest of the second jaw member 124 and operate like rollers to assist the operator in moving second jaw member 124 back and forth along the elongated member 128.

The clam shell housing halves may be connected to one another in a variety of manners, but preferably are connected via fasteners, such as screws, so that the housings can be separated to provide access to the components within the second clamping jaw member 124. When assembled, the clam shell housing halves connect to form a parting line 124*p* about which the body 124*a* is symmetrical. The apparatus 120 may also have a jaw pad or cover attached to the abutment surface 124*d* of second clamping jaw member 124 to engage the workpiece with. As mentioned above, the face of the jaw pad may be smooth or contoured to better fit specific types of workpieces.

In the embodiment illustrated in FIGS. 13A-D, the locking arm 126 includes a body portion 126*a* which defines an aperture for receiving the elongated member 128, an aperture 126*c* for receiving a portion of the pressure application member 134, and an aperture for receiving the brake release mechanism 140. Although the shape of the locking arm body 126*a* differs in some respects from the locking arm bodies discussed above, its function and performance remains the same. Extending out from the brake release aperture and gusset walls of the locking arm body 126*a* is the brake lever 142 of the brake release mechanism 140. In a preferred form, a handle grip 148 is connected to the end of the brake release lever 142 and is contoured with a similar finger support 148*a* and overmolding 148*b* as those discussed above. Unlike the earlier embodiments, however, the handle grip 148 is enlarged to increase the surface area thereof so that the user can more easily locate, grasp and actuate the braking mechanism 140. The brake lever 142 is also provided in a more rounded form to prevent the need for sharp corners or bends which can weaken the structural integrity of the lever.

Figure 13A:
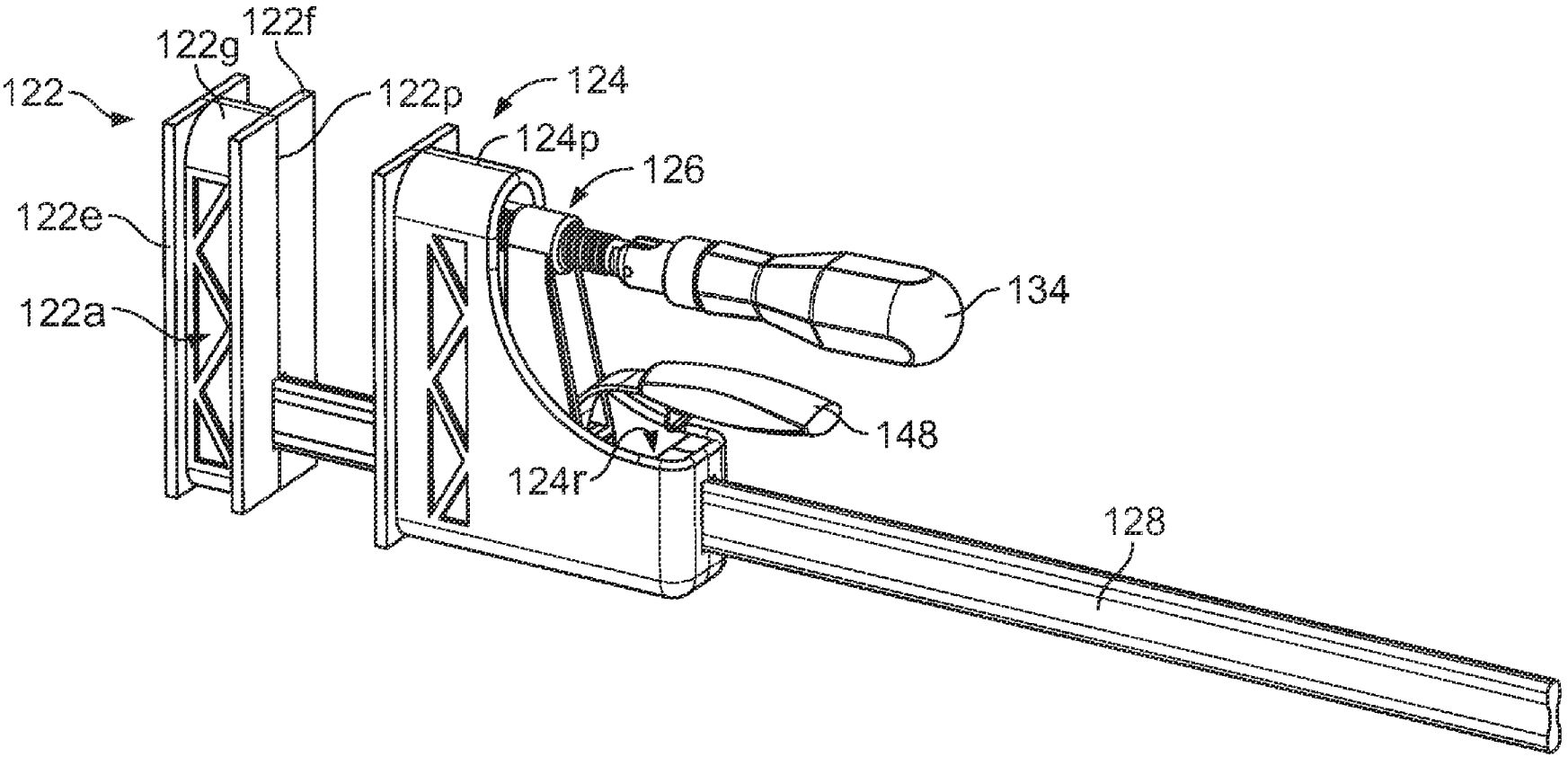
FIG. 13A is a perspective view of an alternate parallel clamp embodying features of the present invention including a pivoting handle.
Figure 13B:
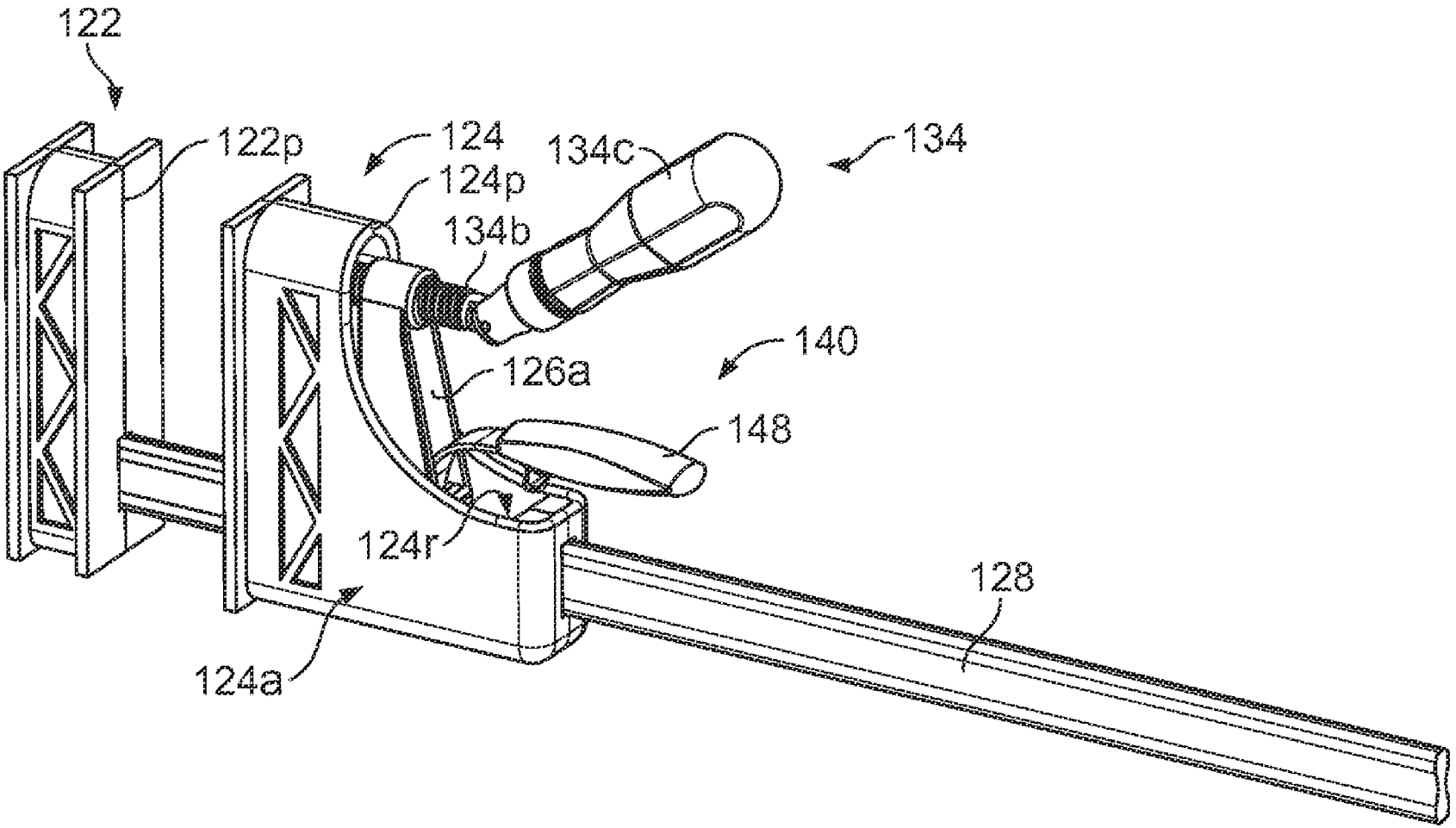
FIG. 13B is a perspective view of the parallel clamp of FIG. 13A, showing the handle pivoted into another position.
Figure 13C:
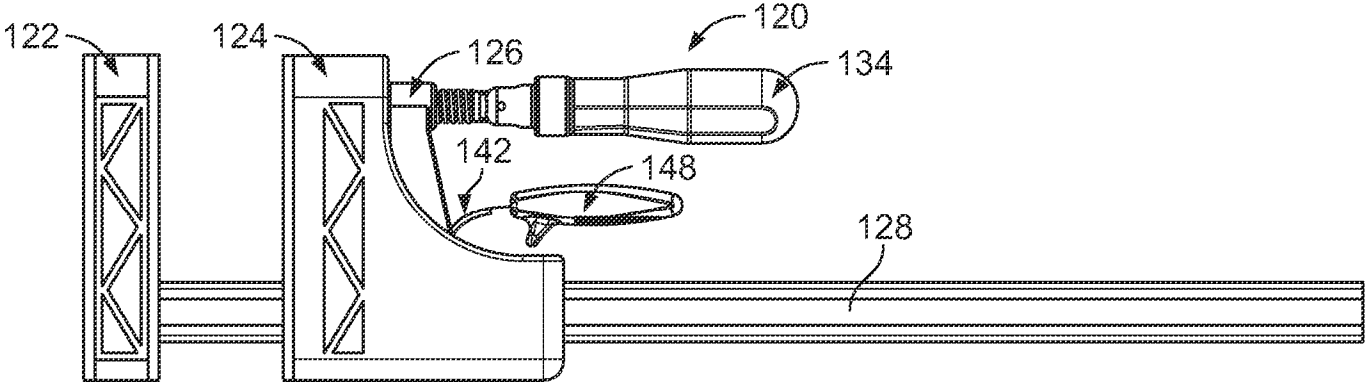
FIG. 13C is a side elevational view of the parallel clamp of FIG. 13A.
Figure 13D:
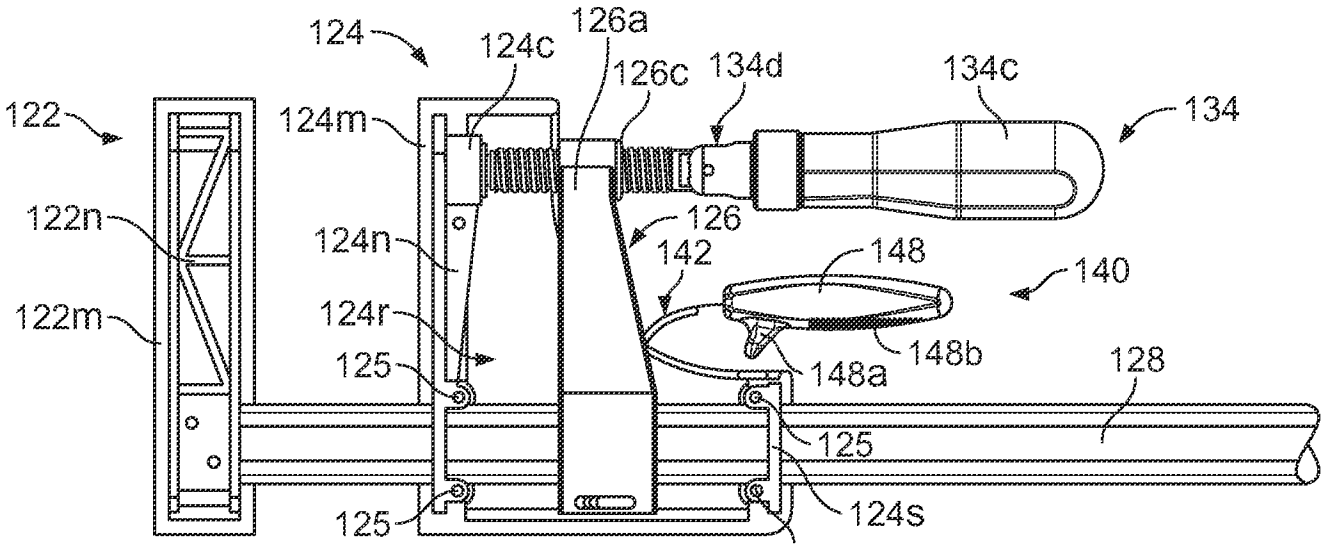
FIG. 13D is a side elevational view of the parallel clamp of FIG. 13A showing the apparatus with one side of the clam shell housings covering the first and second clamping jaw members removed to expose the metal inserts and other components.

In a preferred embodiment, the bottom surfaces of the first and second clamping jaw members 122 and 124 are coplanar, as illustrated in FIGS. 13C-D, to support the apparatus 120 when used in a free-standing manner. In alternate forms, however, a stop may be provided on the end of the elongated member 128 to assist in supporting the apparatus 120 in a free-standing application and to maintain the elongated member 128 generally parallel to a flat work surface.

Like the embodiments discussed above, the pressure application member 134 includes an end portion, a threaded shaft 134*b* and a body, such as handle 134*c*, for actuating the pressure application member 134. Unlike the earlier embodiments, however, the pressure application member includes a pivot joint 134*d* about which the handle may be pivoted to position the handle 134*c* in a manner that is easier to operate and/or provides additional leverage to the user. Thus, if the user is working with a workpiece which requires a large amount of force to be applied by the apparatus 120, he or she may pivot the handle about the pivot axis or pin 134*e* of pivot joint 134*d* and into a position which is more comfortable to operate and/or provides greater leverage for applying force to the pressure application member 134.

Figure 13E:
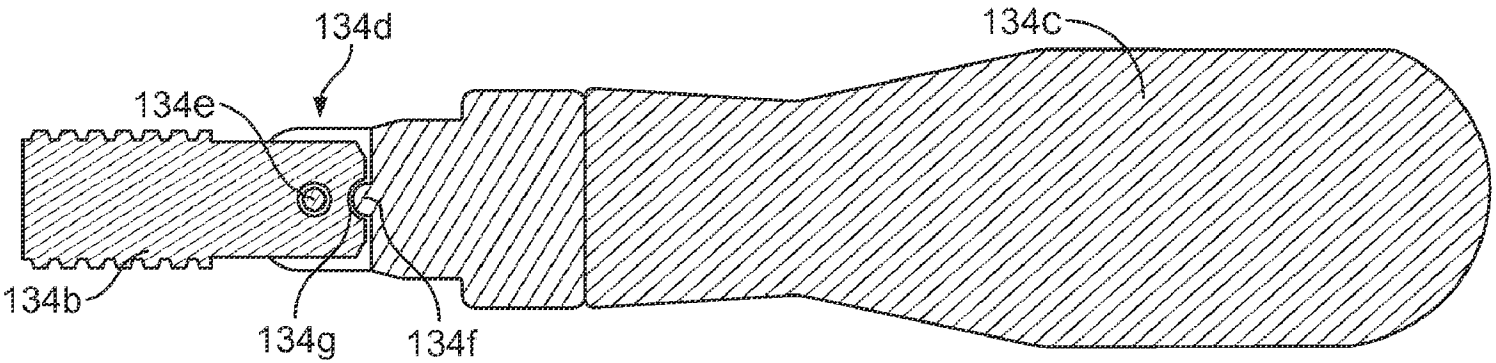
FIG. 13E is an enlarged cross-sectional view of a portion of the handle and shaft of the pressure application member of FIG. 13A as viewed along the longitudinal access of the parallel clamp.
Figure 14:
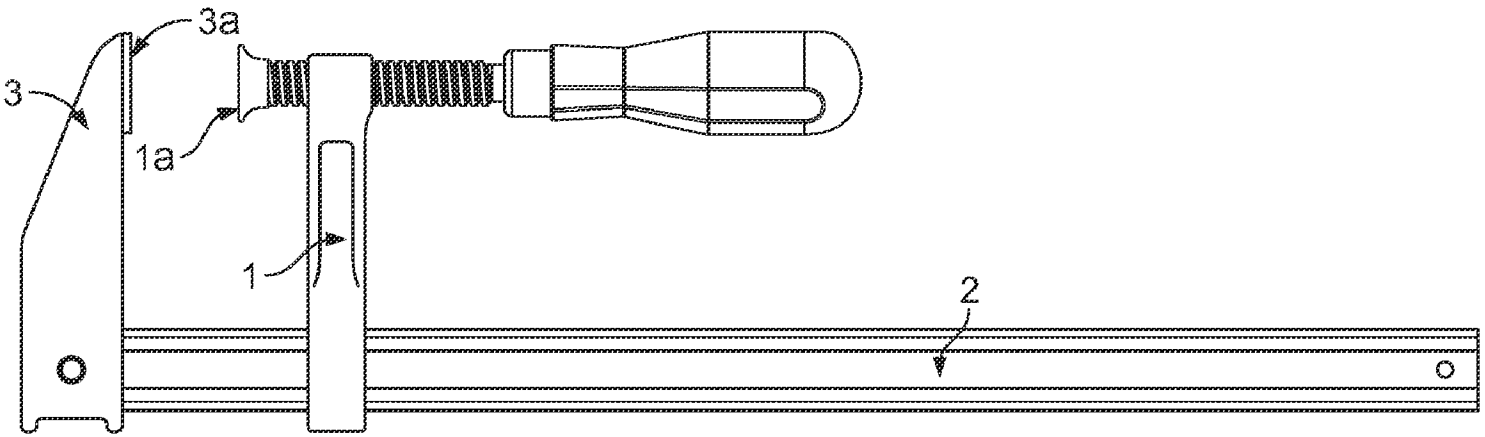
FIG. 14 (Prior Art)
FIG. 14 is a side elevational view of a traditional bar clamp having a passive locking system.
Figure 15:
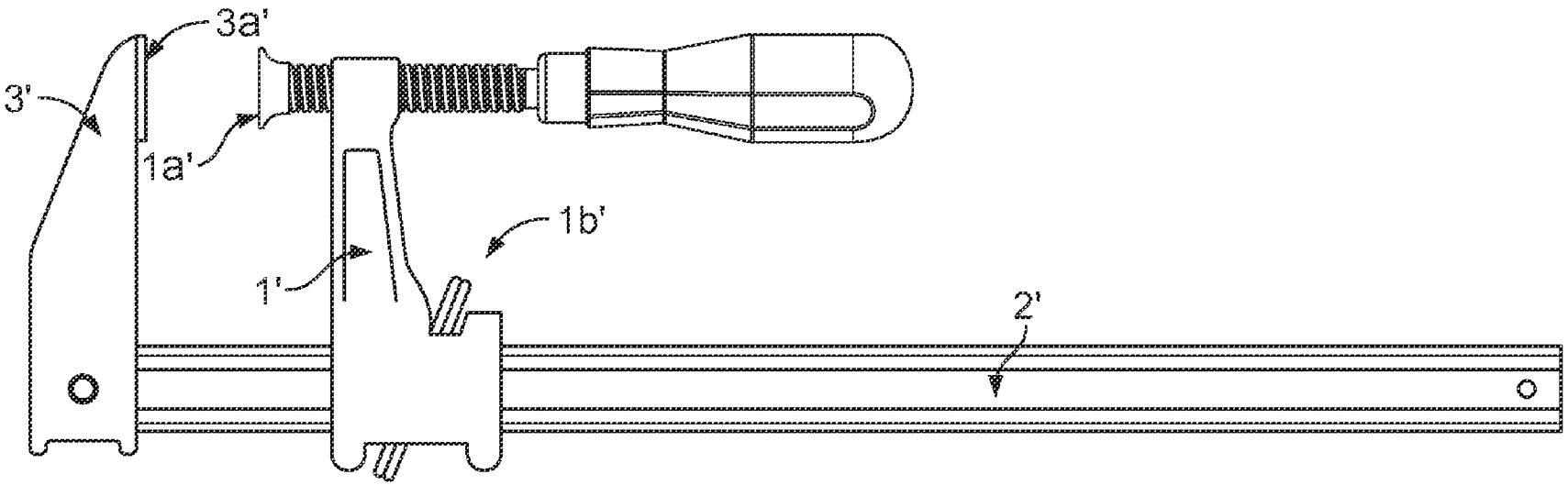
FIG. 15 (Prior Art)
FIG. 15 is a side elevational view of a traditional bar clamp having a brake plate for locking the movable jaw member in a desired position on the bar.

In a preferred form, the pivot joint 134*d* is configured so that some force is required to pivot the handle from its initial position, in which the handle 132*c* is coaxial with the threaded shaft 134*b*, to an angled position with respect to threaded shaft 134*b*. For example, in the embodiment illustrated in FIG. 13E, the handle 134*c* has a projection, such as resilient ball 134*f*, extending from the surface facing the shaft 134*b*, and the shaft 134*b* has a mating recess, such as detent 134*g*, on the surface facing the handle 134*c*. Thus, in order to pivot the handle 134*c* away from its initial position wherein the ball 134*f* rests within the detent 134*g*, enough force must be applied to remove the ball 134*f* from the detent 134*g*. This configuration will help prevent the handle from inadvertently pivoting out of its initial position, particularly when the user is trying to actuate the brake mechanism 140 while the handle is in the initial position.

In alternate embodiments, the projection may extend from the shaft 134*b* and the mating recess may be located on the handle 134*c*. In yet other embodiments, the pivot joint 134*d* may use other indexing mechanisms to maintain the handle 134*c* in a predetermined position. For example, the pivot joint 134*d* may have a spring biased ball projection wherein the ball is depressed and compresses the spring when the handle is shifted out of its initial position or from one indexing position to another. In one form, the pivot joint 134*d* may have multiple indexing positions which retain the handle 134*c* at various predetermined positions. For example, the shaft 134*b* may have three mating recesses, such as detents, that capture the projection and position the handle 134*c* at its initial position or at positions which are ninety degrees (90°) to the initial position so that the handle may quickly be moved to and secured in any of these positions.

Another form of the apparatus is illustrated in FIGS. 16A-18B. For convenience, items in this embodiment which are similar to items discussed above will be identified using the same reference numeral in combination with the prefix "2" merely to distinguish embodiments. Thus, the apparatus 220 includes a first clamping jaw member 222, a second clamping jaw member 224, a locking arm 226 and an elongated member 228 to which the first and second clamping jaw members 222 and 224 and locking arm 226 are adjustably mounted to clamp or spread workpieces. The apparatus 220 also includes a support member 250 which is located on the elongated member 228 on the side opposite the first clamping jaw member 222.

Figure 16A:
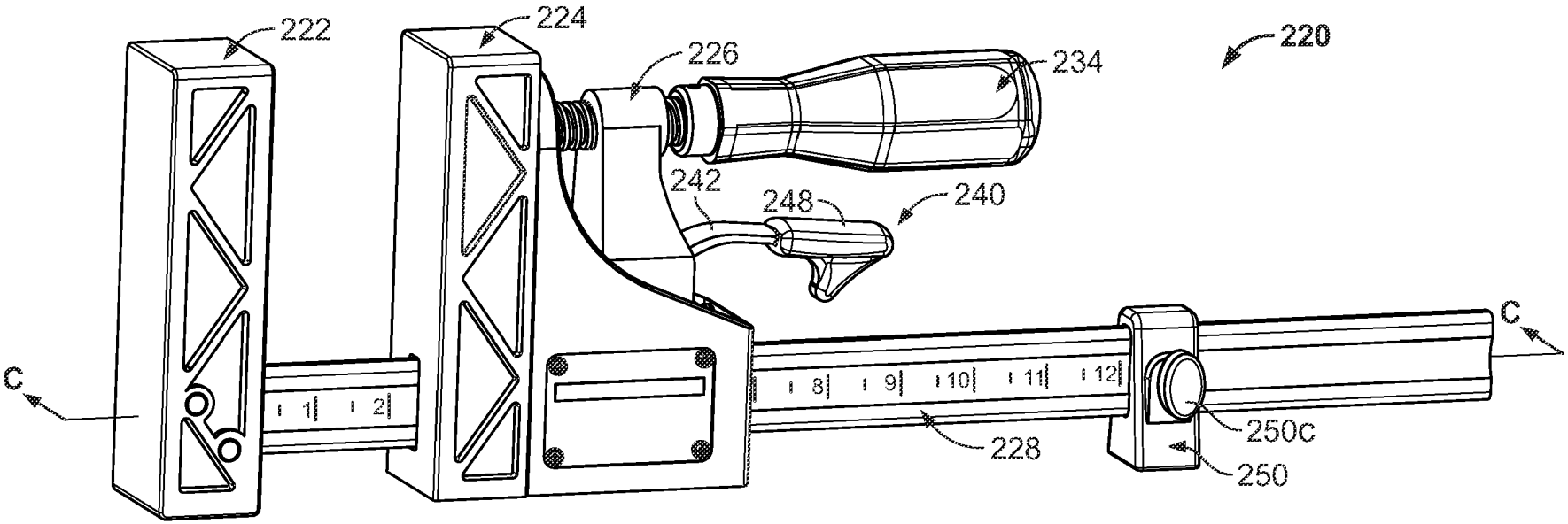
FIGS. 16A-B are perspective views of a parallel clamp embodying features of the present invention including a graduated elongated member.
Figure 16B:
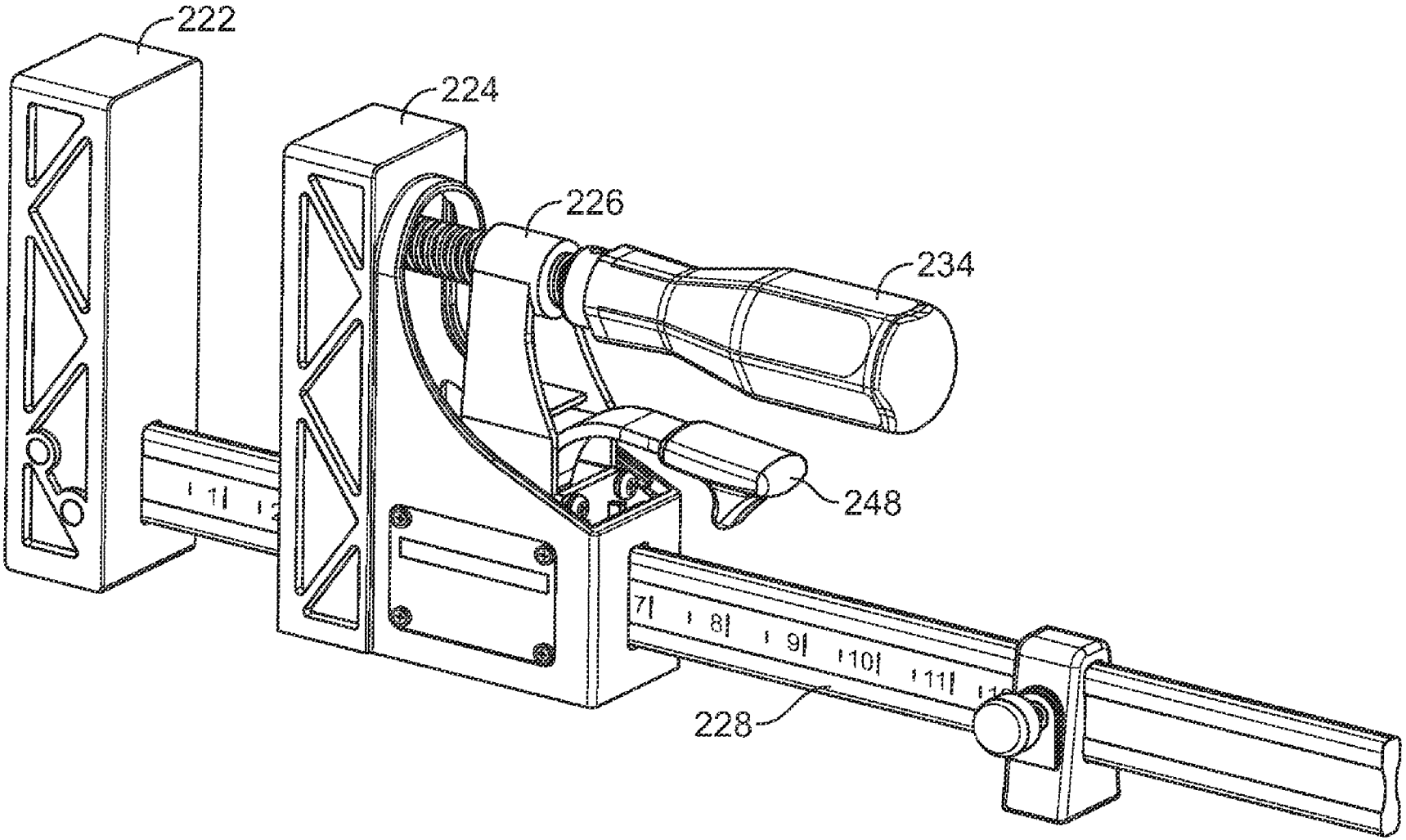
Figure 16C:
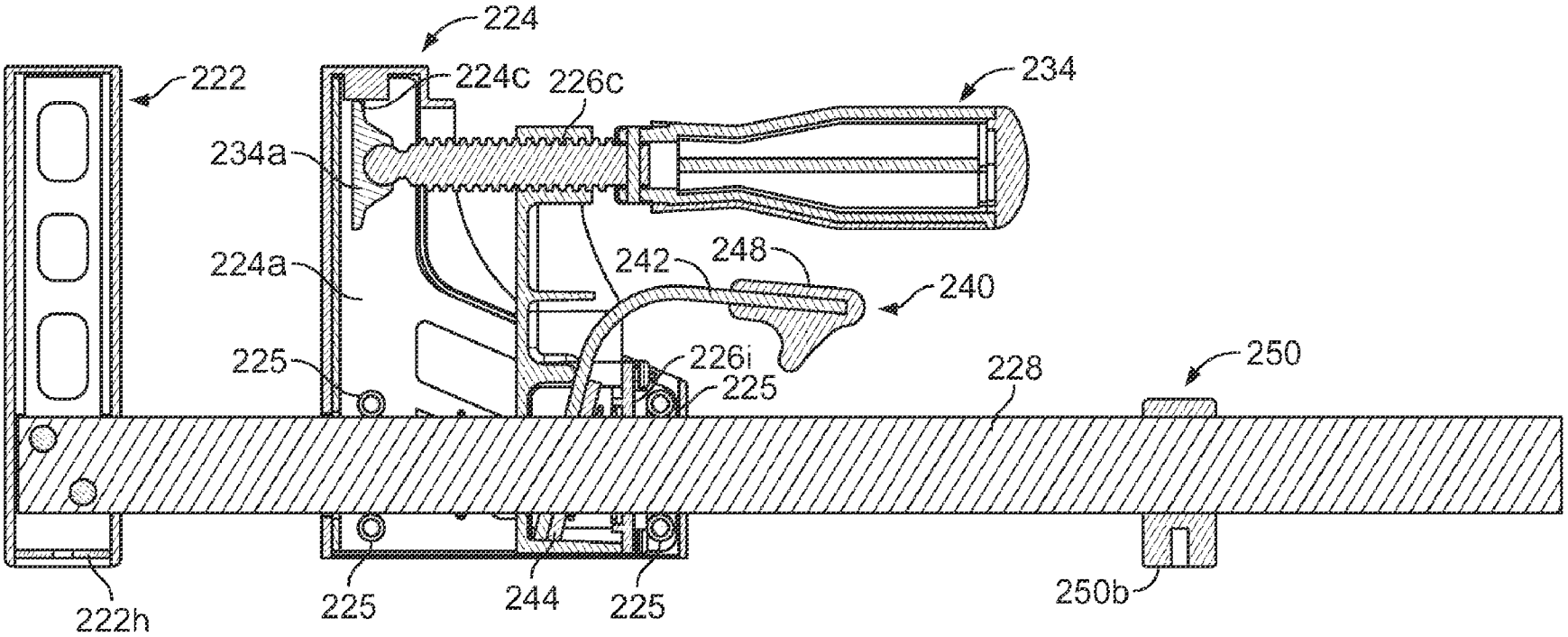
FIG. 16C is a cross-sectional view of the parallel clamp of FIG. 16A as viewed along line C-C of FIG. 16A.
Figure 16D:
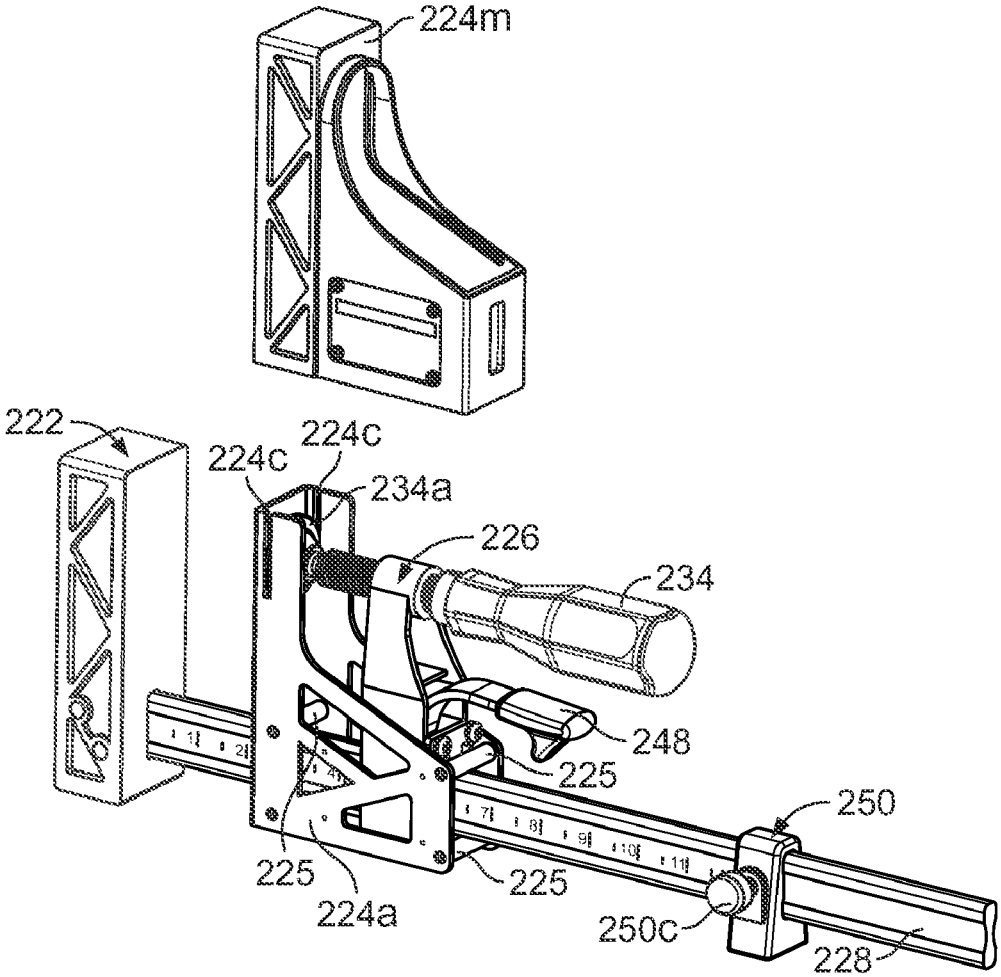
FIG. 16D is a partially exploded view of the parallel clamp of FIG. 16A showing the outer housing exploded from the second clamp member.

As shown in FIGS. 16A-B, the elongated member 228 may be graduated (e.g., divided into marked intervals for use in measurement). This graduated scale allows a user to adjust the parallel clamp to a desired width when securing a workpiece. It also allows the user to easily measure the workpiece or portions thereof and secure the workpiece at a desired length or measurement. The units of measurement may be any desired units of measurement, such as inches or centimeters, and may include any divisions thereof. It should also be understood that this graduated scale may be used with other embodiments of the present invention and with bar clamps in general.

The second jaw member 224 has a frame 224*a* and an outer body or housing 224*m* that extends along the elongated member 228 and around at least a portion of the locking arm 226. Thus, the locking arm 226 rides in the frame 224*a* and housing 224*m* as the second clamping jaw member 224 and arm 226 are moved along the elongated member 228. The frame 224*a* has pins 225 which capture the elongated member 228 and maintain the second jaw member 224 parallel to the first jaw member 222 and perpendicular to the elongated member 228. In the form illustrated, the pins 225 rotate with respect to the rest of the frame 224*a* and operate like rollers to assist the operator in moving second jaw member 224 and locking arm 226 back and forth along the elongated member 228. The frame 224*a* also defines a receptacle, such as slot 224*c*, for receiving an end of the pressure application member 234. In this form, the slot 224*c* and frame 224*a* help ensure that the locking arm 226 will move smoothly along the elongated member 228 when the operator pushes or pulls the handle 234.

Figure 17:
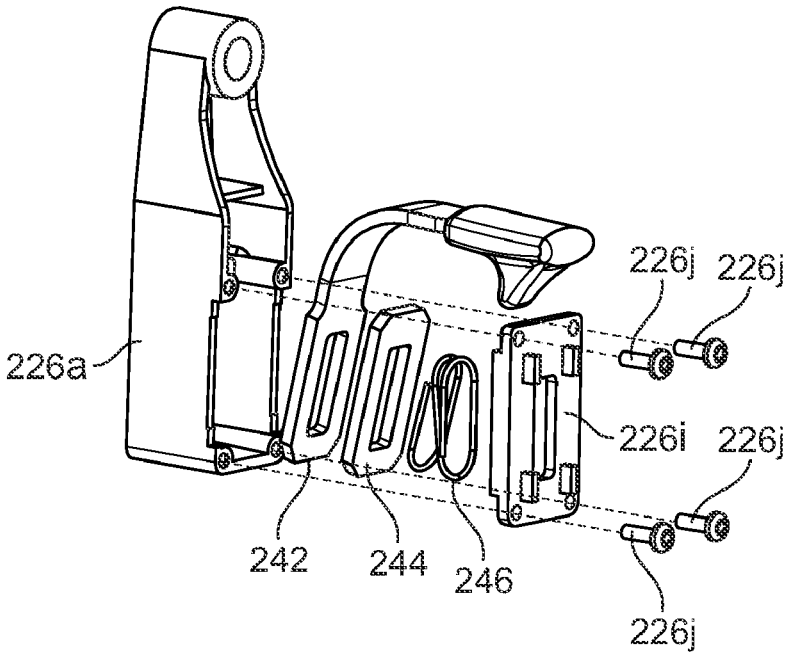
FIG. 17 is an exploded view of the locking arm of the parallel clamp of FIG. 16A.

An exploded view of the locking arm 226 is illustrated in FIG. 17. In this embodiment, the brake release lever 242, brake plate 244 and spring 246 are encapsulated in and/or connected to the body 226*a* of the locking arm 226 via panel 226*i*, which is preferably connected to the body 226*a* via fasteners, such as screws 226*j*. The bottom of the locking arm 226 is generally flat and coplanar with the bottom surfaces of the second jaw member frame 224*a* and housing 224*m* and with the bottom surfaces of the support member 250 and first jaw member 222.

Figure 18A:
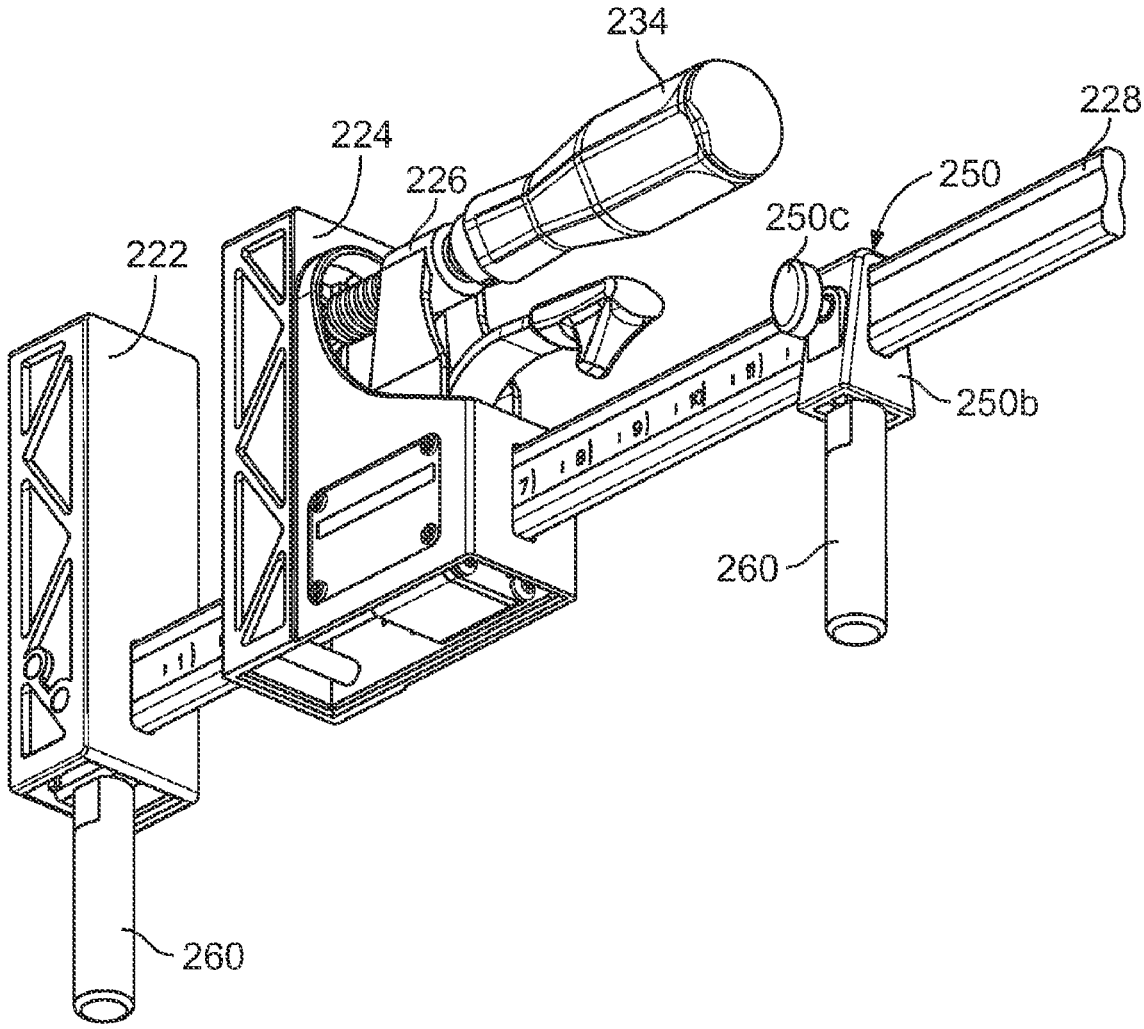
FIGS. 18A-B are perspective views of the parallel clamp of FIG. 16A showing accessories for securing the clamp to a work surface connected to and exploded from the parallel clamp, respectively.
Figure 18B:
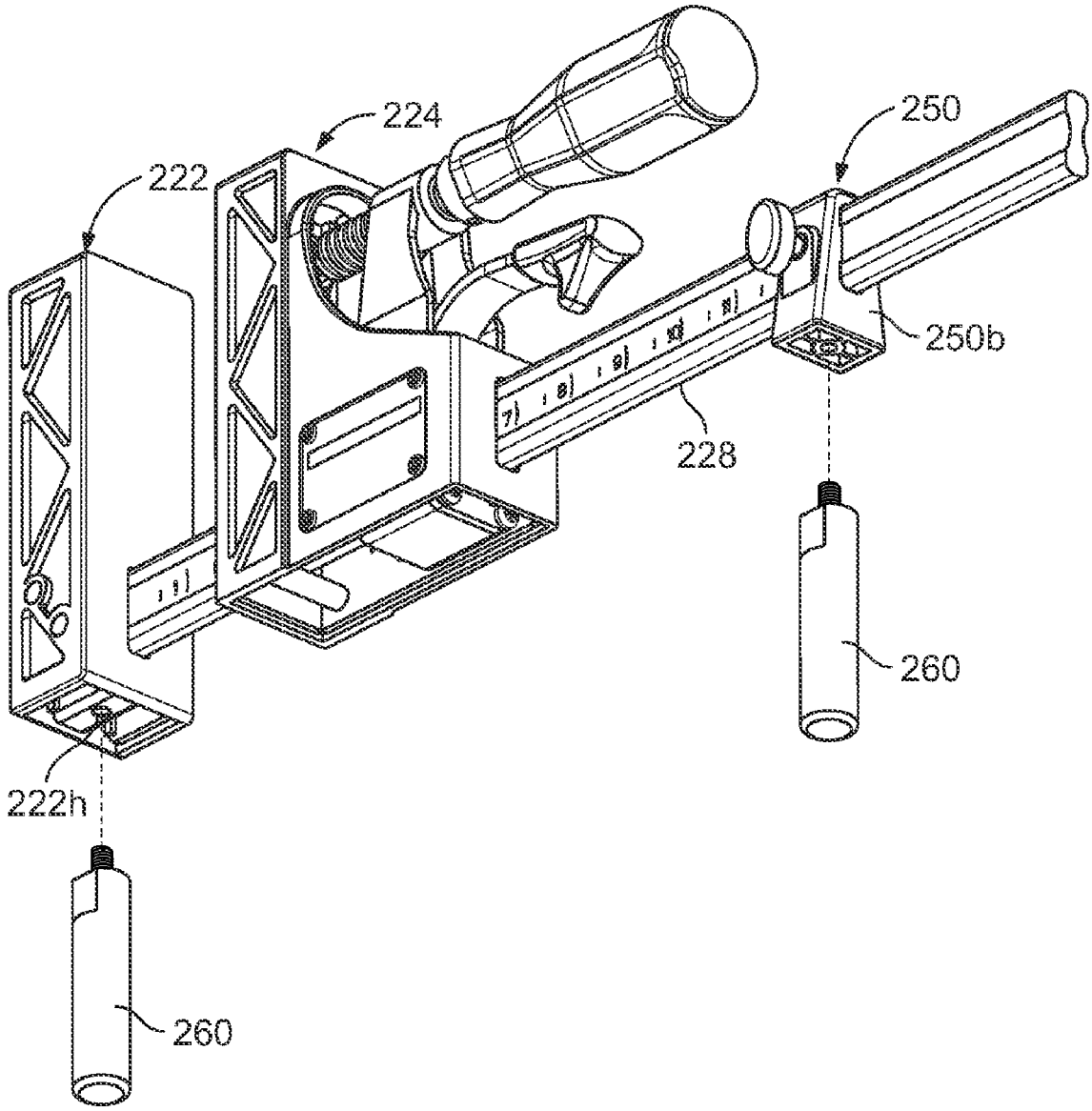
Figure 19B:
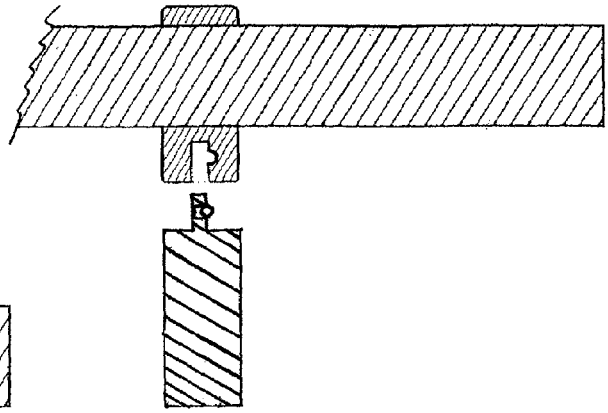
FIGS. 19A-19B are schematic cross-sectional views of an alternate embodiment of the parallel clamp of FIG. 16A.
Figure 19A:
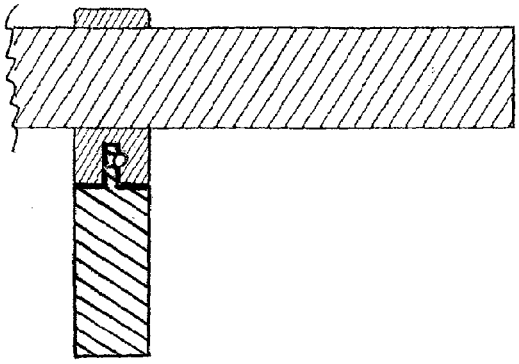
Figure 20B:
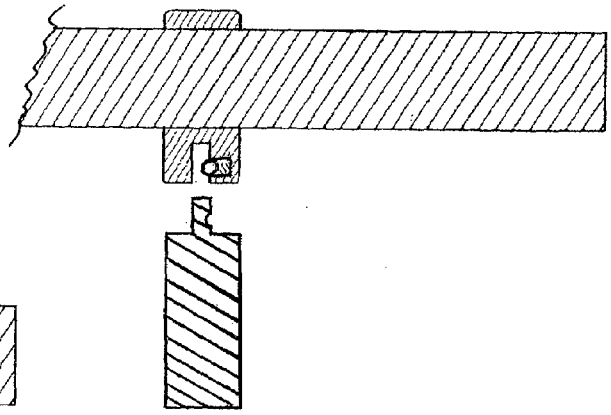
FIGS. 20A-20B are schematic cross-sectional views of an alternate embodiment of the parallel clamps of FIG. 16A.
Figure 20A:
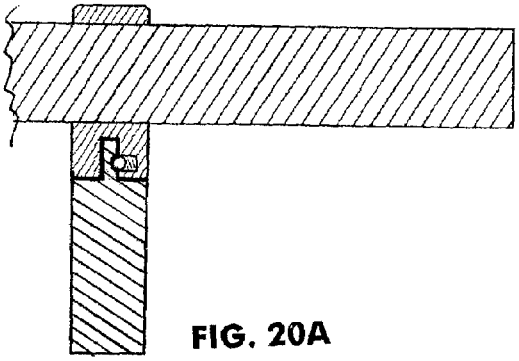

In FIGS. 18A-B, protrusions, such as pegs or bench dogs 260, are shown as separate components or accessories that may be attached to the structure of the apparatus 220. As discussed above, the pegs 260 may be fastened, connected or secured to the apparatus in a variety of manners. For example, in the form illustrated, the pegs 260 are threadedly engaged to corresponding threaded bores located in the base 222*h* of the first clamping jaw member 222 and in the base 250*b* of the support member 250. In addition, the pegs 260 are sized such that they may be received by openings located in a work surface, such as peg openings or bench dog holes in a workbench or table top. The work surface may contain numerous peg holes spaced apart to form a grid, which may include random, varying, or consistent spacing, such as a peg-board-like work surface having regularly spaced holes, to allow the user to position the apparatus 220 in various orientations as desired on the work surface.

In operation, the pegs 260 are secured to the apparatus 220 so that the apparatus can be connected to the work surface in a desired manner. In the embodiment illustrated, the peg 260 of the base 222*h* will be inserted into a first peg opening and the peg 260 of the support 250 will be inserted into a second peg opening. If the distance between the peg openings is known, the support 250 can be adjusted to ensure that the pegs 260 are spaced an appropriate distance apart so that the apparatus 220 can be attached to the work surface. The graduated rulings or scale of the elongated member 228 can also be used to assist the operator in moving the stop 250 and associated peg 260 to the desired distance or at least to a position that is generally about the appropriate distance from the peg 260 attached to base 222*h*. Alternatively, the operator may simply align the peg 260 of base 222*h* above a first peg opening in the work surface and then move and/or align the support 250 so that the peg 260 associated therewith may be inserted into a second peg opening in the work surface. Once positioned, the support 250 may be secured into position via a fastener, such as set screw 250*c*. Thus, unlike conventional blocks which may be used to secure a bar clamp to a work surface with peg openings, the pegs 260 allow the apparatus 220 itself to be connected directly to the work surface.

In alternate embodiments, the pegs 260 may be connected to the first and second clamp members 222 and 224, rather than the first clamp member 222 and support 250. In order to allow for the pegs 260 to be spaced apart from one another at different lengths, one of the pegs 260 will be slideably connected to one of the clamp members 222 and 224. For example, in one form, the threaded bore of movable clamp member 224 may be formed by a plate that is slideably connected to the movable clamp member 224 in order to allow the peg 260 connected to clamp member 224 to be movable with respect to the clamp member 224 so that the pegs 260 may be spaced apart from one another at different distances. Such a configuration may also be used to allow at least one of the clamp members 222 and 224 to be moved once the apparatus 220 has been connected to the work surface via the pegs 260. For example, if peg 260 is connected to a movable plate associated with clamp member 224, the clamp member 224 will remain movable with respect to the work surface and peg 250 even after its associated peg 260 has been connected to the work surface.

Although the parallel clamp assemblies illustrated and discussed herein primarily show and describe the clamping jaw members connected to the elongated member in a clamping arrangement, it should be understood that the clamp members may be arranged in either a clamping or spreading configuration depending on the application at hand. It should also be understood that various changes in the details, materials, and arrangements of parts and components which have been herein described and illustrated in order to explain the nature of the invention may be made by those skilled in the art within the principle and scope of the invention as expressed in the appended claims.

What is claimed is:

1. An apparatus for securing a workpiece, the apparatus comprising:

an elongated member;

first and second clamping jaw members which are connected to the elongated member with at least one of the clamping jaw members being a moveable clamping jaw member having a body with a through recess through which the elongated member is disposed such that the moveable clamping jaw member is capable of shifting along the elongated member between workpiece engaging and workpiece releasing positions;

an actuator operably connected to the moveable clamping jaw member for advancing the moveable jaw member along the elongated member;

a base portion of the first clamping jaw member for supporting the first clamping member with the base portion resting on a work surface;

a recess disposed on a bottom of the base portion of the first clamping jaw member; and a peg member comprising an end portion for mating with the recess on the base portion and an opposite end portion for mating with a corresponding recess in the work surface for securing the apparatus thereto.

2. An apparatus according to claim 1 wherein one of the peg and mating recess has a lateral protrusion and the other has a secondary recess for receiving the lateral protrusion to assist in securing the peg in the mating recess.

3. An apparatus according to claim 2 wherein the protrusion and secondary recess form a ball and detent configuration.

4. An apparatus according to claim 1 wherein one of the peg and mating recess has a textured surface for frictionally engaging the other to assist in securing the peg in the mating recess.

5. An apparatus according to claim 1 wherein the actuator includes a pressure application member having a pivoting handle capable of being adjusted among a plurality of positions.

6. An apparatus according to claim 5 further comprising:

a brake mechanism connected to the moveable clamping jaw member and having a brake handle shiftable between a brake engaging position wherein the brake mechanism locks the moveable clamping jaw member in a position on the elongated member and a brake releasing position wherein the moveable clamping jaw member is freely movable about the elongated member.

7. An apparatus according to claim 6 wherein the brake handle extends from the brake mechanism and is positioned between the pivoting pressure application member handle and the elongated bar so that a user can use one hand to shift the brake handle between the brake engaging and brake releasing positions while holding the pivoting pressure application member handle with the same hand.

8. An apparatus according to claim 1 wherein the actuator includes a pressure application member having a threaded shaft with a handle pivotally mounted thereto, wherein one of the threaded shaft and handle has a projection and the other has a mating recess for receiving the projection to releasably lock the pivoting handle in a predetermined position.

9. An apparatus according to claim 8, wherein the projection and mating recess form a ball and detent configuration.

10. An apparatus according to claim 9, wherein the ball and detent configuration includes a spring biased ball projection which is movable between a first position wherein the ball compresses the spring and retracts the projection and a second position wherein the spring expands and extends the projection into the mating recess.

11. An apparatus according to claim 1 wherein the moveable clamping jaw member further comprises an arm having first and second apertures, the first aperture defining an opening through which the elongated member is inserted and the second aperture defining an internally threaded bore; and the actuator comprises a pressure application member having a threaded shaft with first and second ends, the threaded shaft being at least partially disposed within the second aperture of the arm with the first end being connected to the moveable clamping jaw member and the second end being pivotally connected to a handle for rotating the threaded shaft to apply or remove pressure via the pressure application member.

12. An apparatus according to claim 11 where the movable clamp member further comprises:

a brake mechanism connected to the arm and having a brake handle movable between a brake engaging position wherein the brake mechanism locks the arm in a position on the elongated member and a brake releasing position wherein the arm is freely movable about the elongated member.

13. An apparatus according to claim 12 wherein the brake handle extends from the brake mechanism and is positioned between the pivoting pressure application member handle and the elongated bar so that a user can use one hand to shift the brake handle between the brake engaging and brake releasing positions while holding the pivoting pressure application member handle with the same hand.

14. An apparatus according to claim 12 further comprising a second brake handle movable between a brake engaging position wherein the brake mechanism locks the arm in a position on the elongated member and a brake releasing position wherein the arm is freely movable about the elongated member.

15. An apparatus according to claim 11 wherein the moveable clamping jaw member is the second clamping jaw member and the first and second apertures of the arm have principal axes that are generally parallel to one another and the first end of the threaded shaft defines a rounded end portion which is disposed in a socket defined by the second clamping jaw member, the generally parallel axes and socket configuration assisting the apparatus in maintaining the second clamping jaw member generally parallel to the first clamping jaw member and generally perpendicular to the elongated member.

16. An apparatus according to claim 1 wherein the elongated member is divided into marked intervals for use in measurement.

17. An apparatus according to claim 1 wherein the mating structure is releasably fastened to the apparatus.

18. An apparatus according to claim 1, wherein the end portion of the peg member is a threaded post and the mating recess of the base portion is a threaded bore for mating with the end portion of the peg member.

19. The apparatus of claim 1, wherein the opposite end portion of the peg member has a smooth outer surface for mating with a smooth inner surface of the corresponding recess of the work surface.

20. The apparatus of claim 19, wherein the opposite end portion of the peg member is generally cylindrically shaped.

21. The apparatus of claim 1, wherein the end portion of the peg member has a smaller circumference relative to a circumference of the opposite end portion.

22. The apparatus of claim 21, wherein the end portion of the peg member is threaded and the recess on the base portion is threaded for mating with the threaded end portion of the peg member.

23. The apparatus of claim 22, wherein the first clamping member is fixedly disposed on an end of the elongated member and the threaded recess is disposed on the base portion of the fixed clamping member.

24. The apparatus of claim 1, further comprising a support member disposed on the elongated member;

a base portion of the support member for resting on the work surface;

a threaded recess disposed in the base portion for mating with a threaded end of a peg member.

25. The apparatus of claim 24, wherein the support member is configured to shift along the elongated member.

26. An apparatus according to claim 1, wherein the actuator comprises a pressure application member including a threaded shaft for advancing the movable jaw member along the elongated member to apply pressure to the workpiece.

27. An apparatus according to claim 1, further comprising a brake connected to the movable jaw member including a handle shiftable between a brake engaging position wherein the brake keeps the movable jaw member from shifting along the elongated member in at least one direction, and a brake releasing position, wherein the movable jaw member is freely movable along the elongated bar.

28. An apparatus according to claim 27, wherein the actuator comprises a pressure application member including a handle for advancing the movable jaw member along the elongated member to apply pressure to the workpiece, and wherein the brake handle is positioned between the pressure application member handle and the elongated member so that a user can use one hand to shift the brake handle between the brake engaging and brake releasing positions while holding the pressure application member handle with the same hand.

29. An apparatus according to claim 1 further comprising:

an arm of the movable jaw member having first and second apertures, the first aperture defining an opening through which the elongated member is inserted and the second aperture defining an internally threaded bore; and wherein the actuator comprises a pressure application member having a threaded shaft with first and second ends, the threaded shaft being at least partially disposed within the second aperture of the arm with the first end being connected to a portion of the movable jaw member and the second end being pivotally connected to a handle for rotating the threaded shaft to apply or remove pressure via the pressure application member.

30. An apparatus according to claim 29 wherein the first and second apertures of the arm have principal axes that are generally parallel to one another and the first end of the threaded shaft defines a rounded end portion which is disposed in a socket defined by the clamping jaw member connected thereto, the generally parallel axes and socket configuration assisting the apparatus in maintaining the first and second clamping jaw members generally parallel to one another and generally perpendicular to the elongated member.

31. A bar clamp comprising:

a transportable elongated bar;

first and second clamping members connected to the elongated bar with at least one of the clamping members having a body with a recess through which the elongated bar is disposed such that the clamping member is shiftable along the elongated bar between workpiece clamping and releasing configurations;

an actuator operably connected to the at least one shiftable clamping jaw member for moving the shiftable jaw member along the elongated bar;

a base portion of the first clamping member that serves as a base for supporting the first clamping member with the base resting on a work surface and a mating structure disposed on the base having a protrusion for mating with a corresponding recess of the work surface to couple the clamp to the work surface.

32. The bar clamp of claim 31, wherein the bar clamp is a parallel clamp, and at least one of the clamping members comprises a brake mechanism shiftable between a braking configuration wherein the at least one clamping member is kept from being shifted and a releasing configuration wherein the at least one clamping member is freely movable along the elongated bar, the brake mechanism including a brake handle for shifting the brake mechanism between braking and releasing configurations.

33. The bar clamp of claim 31, wherein the mating structure comprises a peg with an unthreaded distal end extending from the base for mating with the corresponding recess in the work surface for receiving at least a portion of the peg.

34. The bar clamp of claim 31, further comprising a support member disposed on the elongated bar, wherein the mating structure is operably connected to the support member.

35. The bar clamp of claim 31, wherein the mating structure is a bench dog having a threaded post extending therefrom for mating with a threaded opening defined in a surface of the base of the first clamping member.

36. The bar clamp of claim 31, wherein the first clamping member is fixedly disposed on an end of the transportable bar;

the mating structure includes a threaded end; and the base comprises a threaded recess disposed thereon for mating with the threaded end of the mating structure.

37. A bar clamp having mating structure for quickly and temporarily being connected to a work surface, comprising:

a transportable elongate bar;

a first clamping jaw having a body with a surface for resting on a work surface disposed on one end of the transportable elongate bar;

a second clamping jaw having a body with a recess disposed thereon for receiving the transportable elongate bar therethrough and configured for movement along the transportable elongate bar;

a movable actuating assembly of the second clamping jaw connected to the second clamping jaw body including an arm disposed on the transportable elongate bar and movable with respect thereto to position the actuating assembly at different locations along the transportable elongate bar and a pressure application member with a handle connected to the arm for applying a clamping force to the second clamping jaw;

a support member having a body separate from the clamping jaws disposed on the transportable elongate bar and a surface of the support member body for supporting the transportable elongate bar with respect to the work surface; and a first elongate peg member connected to the surface of the first clamping jaw and a second elongate peg member connected to the surface of the support member body for mating with corresponding recesses in the work surface to connect the bar clamp to the work surface.

38. The clamp of claim 37, wherein the elongate peg members are removable from the first clamping member and the support member.

39. The clamp of claim 38, wherein the surface of the first clamping jaw and the support member each include a threaded recess and the elongate peg members each have a threaded end for threadingly mating with the threaded recesses.

40. The clamp of claim 37, wherein the support member includes a recess through which the transportable elongate bar is disposed and the support member is configured to move along the elongate bar, such that the support member may be positioned at different locations on the transportable elongate bar.

41. The clamp of claim 37, wherein the second clamping jaw further comprises a brake mechanism operably connected to the movable actuating assembly comprising a lever for selectively locking and releasing the actuating assembly with respect to the transportable elongate bar to allow the second clamping jaw to be positioned at different locations along the transportable elongate bar.

42. A bar clamp having mating structure for quickly and temporarily being connected to a work surface, comprising:

a transportable elongate bar;

a first clamping jaw having a body with a surface for resting on a work surface disposed on one end of the transportable elongate bar;

a second clamping jaw having a body with a recess disposed thereon for receiving the transportable elongate bar therethrough and configured for movement along the transportable elongate bar;

a movable actuating assembly of the second clamping jaw connected to the second clamping jaw body including an arm disposed on the transportable elongate bar and movable with respect thereto to position the actuating assembly at different locations along the transportable elongate bar and a pressure application member with a handle connected to the arm for applying a clamping force to the second clamping jaw;

a support member having a body separate from the clamping jaws disposed on the transportable elongate bar and a surface of the support member body for supporting the transportable elongate bar with respect to the work surface; and a first elongate peg member connected to the surface of the support member body for mating with corresponding recesses in the work surface to connect the bar clamp to the work surface.

43. A bar clamp having mating structure for quickly and temporarily being connected to a work surface, comprising:

a transportable elongate bar;

a first clamping jaw having a body with a surface for resting on a work surface disposed on one end of the transportable elongate bar;

a second clamping jaw having a body with a recess disposed thereon for receiving the transportable elongate bar therethrough and configured for movement along the transportable elongate bar;

a movable actuating assembly of the second clamping jaw connected to the second clamping jaw body including an arm disposed on the transportable elongate bar and movable with respect thereto to position the actuating assembly at different locations along the transportable elongate bar and a pressure application member with a handle connected to the arm for applying a clamping force to the second clamping jaw;

a support member having a body separate from the clamping jaws disposed on the transportable elongate bar and a surface of the support member body for supporting the transportable elongate bar with respect to the work surface; and a first elongate peg member connected to the surface of the clamping jaw.

* * * * *